US011763757B2

(12) United States Patent
Zhao et al.

(10) Patent No.: US 11,763,757 B2
(45) Date of Patent: Sep. 19, 2023

(54) PIXEL CIRCUIT AND DISPLAY PANEL

(71) Applicant: YUNGU (GU'AN) TECHNOLOGY CO., LTD., Hebei (CN)

(72) Inventors: Dongfang Zhao, Langfang (CN); Ling Wang, Langfang (CN); Zhe Du, Langfang (CN); Junfeng Li, Langfang (CN); Gang Wang, Langfang (CN); Yong Ge, Langfang (CN)

(73) Assignee: YUNGU (GU'AN) TECHNOLOGY CO., LTD., Hebei (CN)

( * ) Notice: Subject to any disclaimer, the term of this patent is extended or adjusted under 35 U.S.C. 154(b) by 51 days.

(21) Appl. No.: 17/572,895

(22) Filed: Jan. 11, 2022

(65) Prior Publication Data

US 2022/0139337 A1 May 5, 2022

Related U.S. Application Data

(63) Continuation of application No. PCT/CN2020/115118, filed on Sep. 14, 2020.

(30) Foreign Application Priority Data

Dec. 26, 2019 (CN) ..... 201922381601.2

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0819* (2013.01);
(Continued)

(58) Field of Classification Search
CPC ..... G09G 3/3291; G09G 3/3233; G09G 2300/0819; G09G 2300/0861; G09G 2310/0262
See application file for complete search history.

(56) References Cited

U.S. PATENT DOCUMENTS

2011/0193856 A1* 8/2011 Han ..... G09G 3/3233 345/76
2019/0130835 A1* 5/2019 Ka ..... G09G 3/3275
(Continued)

FOREIGN PATENT DOCUMENTS

CN 102222465 A 10/2011
CN 102832229 A 12/2012
(Continued)

OTHER PUBLICATIONS

International Search Report (with English translation) and Written Opinion (with Machine Translation) dated Nov. 27, 2020 in corresponding International Patent Application No. PCT/CN2020/115118; 11 pages.

*Primary Examiner* — Kenneth B Lee, Jr.
(74) *Attorney, Agent, or Firm* — Maier & Maier, PLLC

(57) ABSTRACT

The pixel circuit includes a data-writing module, a drive module, a storage module, a first light emission control module, a second light emission control module, a light-emitting module and a first initialization module. A first terminal of the first initialization module is electrically connected to a second light emission control signal input terminal, a second terminal of the first initialization module is electrically connected to a control terminal of the drive module; or the pixel circuit includes an initialization voltage input terminal, the first terminal of the first initialization module is electrically connected to the initialization voltage input terminal, the second terminal of the first initialization module is electrically connected to the control terminal of the drive module. The first initialization module is configured to initialize the control terminal of the drive module under a control of a control signal input into a control terminal of the first initialization module.

18 Claims, 31 Drawing Sheets

(52) U.S. Cl.
CPC ..... *G09G 2300/0861* (2013.01); *G09G 2310/0262* (2013.01)

(56) References Cited

U.S. PATENT DOCUMENTS

| | | | | |
|---|---|---|---|---|
| 2020/0243013 | A1* | 7/2020 | Wang | G09G 3/3233 |
| 2021/0366383 | A1* | 11/2021 | Ma | G09G 3/3233 |

FOREIGN PATENT DOCUMENTS

| | | | |
|---|---|---|---|
| CN | 106409866 | A | 2/2017 |
| CN | 107610652 | A | 1/2018 |
| CN | 109256094 | A | 1/2019 |
| CN | 107316606 | B | 6/2019 |
| CN | 210896559 | U | 6/2020 |

* cited by examiner

PIXEL CIRCUIT AND DISPLAY PANEL

CROSS-REFERENCE TO RELATED APPLICATIONS

This application is a continuation of International Patent Application No. PCT/CN2020/115118, filed on Sep. 14, 2020, which claims priority to Chinese Patent Application No. 201922381601.2 filed on Dec. 26, 2019, the disclosures of both of which are incorporated herein by reference in their entireties.

TECHNICAL FIELD

Embodiments of the present disclosure relate to the field of display technologies, for example, to a pixel circuit and a display panel.

BACKGROUND

With the development of display technologies, people have increasingly higher requirements for display effects.

A display panel generally includes a plurality of pixel circuits and a plurality of light-emitting devices, and the light-emitting devices are driven by the pixel circuits to emit light for display.

However, for the display panel, there is a short-term residual shadow in the display panel, which makes the display effects poor.

SUMMARY

The present disclosure provides a pixel circuit and a display panel, so as to improve the phenomenon of short-term residual shadow and improve the display effects.

In a first aspect, an embodiment of the present disclosure provides a pixel circuit. The pixel circuit includes: a data-writing module, a drive module, a storage module, a first light emission control module, a second light emission control module, a light-emitting module and a first initialization module.

The data-writing module is configured to write a data voltage into a control terminal of the drive module in response to a scanning signal input into a first scanning signal input terminal being turned on.

A control terminal of the first light emission control module is electrically connected to a first light emission control signal input terminal of the pixel circuit, a control terminal of the second light emission control module is electrically connected to a second light emission control signal input terminal of the pixel circuit, a first terminal of the drive module is connected to a first power voltage input terminal through the first light emission control module, a second terminal of the drive module is connected to a first terminal of the light-emitting module through the second light emission control module, and a second terminal of the light-emitting module is connected to a second power voltage input terminal; and the storage module is configured to store a potential of the control terminal of the drive module.

The first initialization module includes a control terminal, a first terminal and a second terminal. The first terminal of the first initialization module is electrically connected to the second light emission control signal input terminal, and the second terminal of the first initialization module is electrically connected to the control terminal of the drive module; or the pixel circuit includes an initialization voltage input terminal, the first terminal of the first initialization module is electrically connected to the initialization voltage input terminal, and the second terminal of the first initialization module is electrically connected to the control terminal of the drive module. The first initialization module is configured to initialize the control terminal of the drive module under a control of a control signal input into the control terminal of the first initialization module.

In a second aspect, an embodiment of the present disclosure further provides a display panel. The display panel includes the pixel circuit provided in the first aspect.

Embodiments of the present disclosure provide a pixel circuit and a display panel. The pixel circuit includes a first initialization module, a first terminal of the first initialization module is electrically connected to a second light emission control signal input terminal or an initialization voltage input terminal, a second terminal of the first initialization module is electrically connected to a control terminal of a drive module, and the first initialization module is configured to initialize the control terminal of the drive module under a control of a control signal input into a control terminal of the first initialization module. A first light emission control module can be turned on under a control of an input signal of a first light emission control signal input terminal, and a high-level signal input into a first power voltage input terminal is transmitted to a first terminal of the drive module. Further, in a first initialization stage, the potential of the control terminal of the drive module and the potential of the first terminal of the drive module are fixed, drive modules in various pixel circuits in the display panel including the pixel circuits have the same potential at control terminals and have the same potential at first terminals in the first initialization stage, that is, the drive modules in the various pixel circuits have the same working state. In the case that the drive modules are drive transistors, drive transistors which drive light-emitting devices to display different gray scales in the previous frame can be restored to the same working state, so that the capture and release of carries on active layers, gate electrode insulating layers and interfaces between the active layers and the gate electrode insulating layers of various drive transistors are basically the same. Therefore, when different gray scales are converted to the same gray scale, the magnitude of drive currents is the same, the brightness of the light-emitting devices is the same, thus the phenomenon of residual shadow is improved, and the display effects are improved.

DETAILED DESCRIPTION

Figure 1:
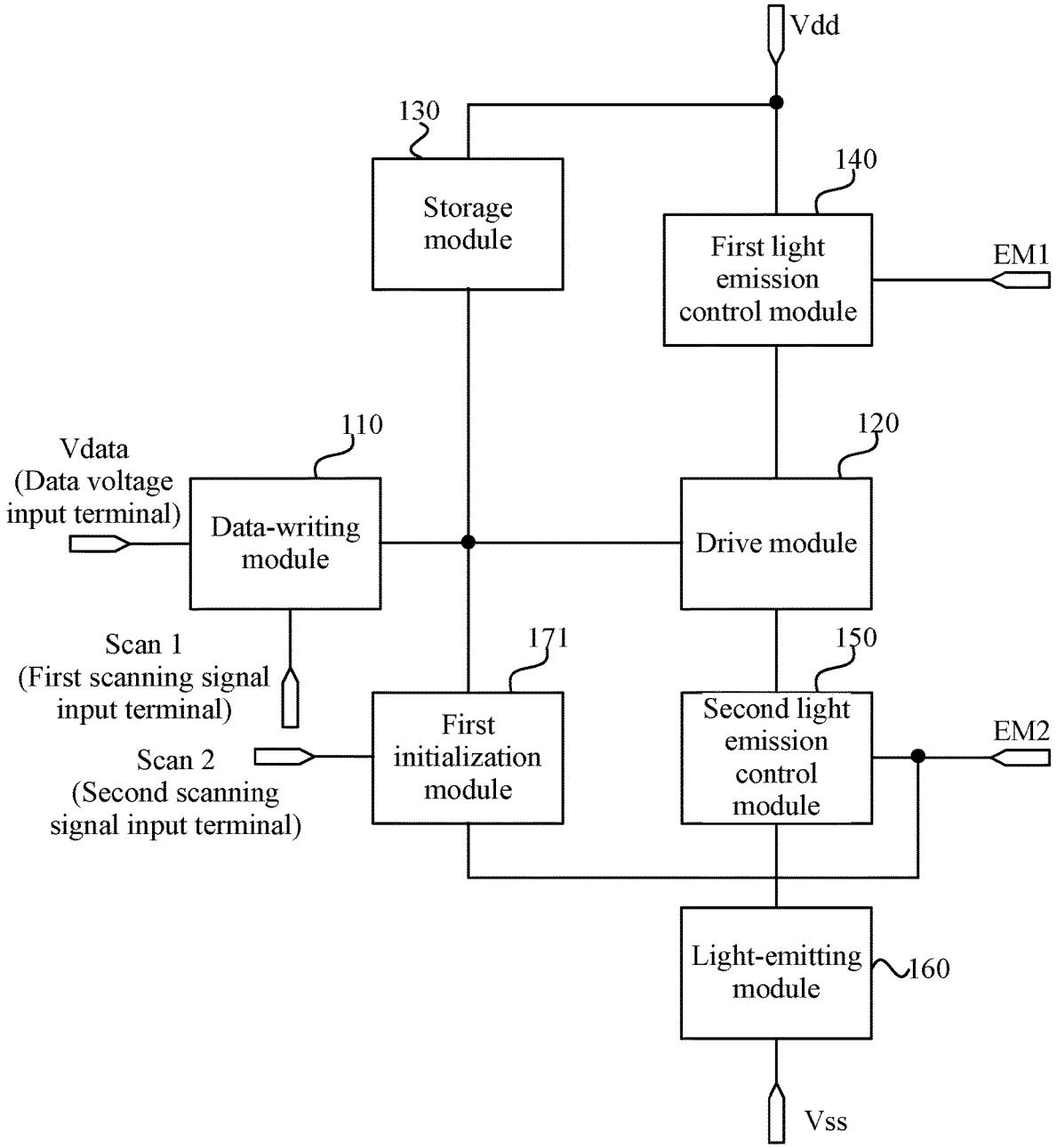
FIG. 1 is a structural diagram of a pixel circuit according to an embodiment of the present disclosure.

The situation of short-term residual shadow exists in existing display panels. For example, when light-emitting devices which originally displayed different gray scales in the display panel switch to the same gray scale, the brightness of the light-emitting devices are different, which makes the display effects poor. According to the inventor's research, an existing display panel generally includes a plurality of pixel circuits. The pixel circuit includes a drive transistor which drives a light-emitting device to emit light. The drive transistor controls the brightness of the light-emitting device by controlling the drive current flowing through the light-emitting device. The magnitude of the drive current generated by the drive transistor is related to the gate-source voltage difference of the drive transistor. When displayed gray scales are different, gate-source voltage differences of the drive transistor are different. The gate-source voltage difference of the drive transistor makes the working state of the drive transistor different, and thus a difference exist in the degree of the capture and release of carries at an active layer, a gate electrode insulating layer and the interface between the active layer and the gate electrode insulating layer of the drive transistor. Therefore, when different gray scales are converted to the same gray scale, drive currents of drive transistors are different, which eventually leads to differences in the brightness and forms residual shadow. Moreover, in the related art, when the gate electrode of the drive transistor is initialized, the source electrode of the drive transistor is generally in a floating state, so that a change of the potential of the gate electrode will also cause a change of the potential of the source electrode, making the reset of the drive transistor insufficient. As a result, the phenomenon of short-term residual shadow still exists.

The embodiments of the present disclosure provide a pixel circuit. The pixel circuit includes: a data-writing module, a drive module, a storage module, a first light emission control module, a second light emission control module, a light-emitting module and a first initialization module.

The data-writing module is configured to write a data voltage into a control terminal of the drive module in response to a scanning signal input into a first scanning signal input terminal being turned on.

A control terminal of the first light emission control module is electrically connected to a first light emission control signal input terminal of the pixel circuit, a control terminal of the second light emission control module is electrically connected to a second light emission control signal input terminal of the pixel circuit, a first terminal of the drive module is connected to a first power voltage input terminal through the first light emission control module, a second terminal of the drive module is connected to a first terminal of the light-emitting module through the second light emission control module, and a second terminal of the light-emitting module is connected to a second power voltage input terminal; and the storage module is configured to store a potential of the control terminal of the drive module.

The first initialization module includes a control terminal, a first terminal and a second terminal.

The first terminal of the first initialization module is electrically connected to the second light emission control signal input terminal, and the second terminal of the first initialization module is electrically connected to the control terminal of the drive module; or the pixel circuit includes an initialization voltage input terminal, the first terminal of the first initialization module is electrically connected to the initialization voltage input terminal, and the second terminal of the first initialization module is electrically connected to the control terminal of the drive module.

The first initialization module is configured to initialize the control terminal of the drive module under a control of a control signal input into the control terminal of the first initialization module.

The drive module may be a drive transistor, a gate electrode of the drive transistor may be configured as the control terminal of the drive module, a first electrode of the drive transistor may be configured as the first terminal of the drive module, and the first electrode of the drive transistor may be the source electrode of the drive transistor or the drain electrode of the transistor. An example in which the drive transistor is the drive module and the first terminal of the drive transistor may be the source electrode of the drive transistor is described below.

In an embodiment, the working process of the pixel circuit may include a first initialization stage, a data-writing stage and a light emission stage. In the first initialization stage, the signal input into the second light emission control signal input terminal may be the same as the signal input into the first power voltage input terminal in the case that the first terminal of the first initialization module is electrically connected to the second light emission control signal input terminal. In an embodiment, when a high-level signal is input into the first power voltage input terminal, the signal input into the second light emission control signal input terminal is also a high-level signal. In the first initialization stage, the signal input into the initialization voltage input terminal may be the same as the signal input into the first power voltage input terminal in the case that the first terminal of the first initialization module is electrically connected to the initialization voltage input terminal. In an embodiment, when a high-level signal is input into the first power voltage input terminal, the signal input into the initialization voltage input terminal is also a high-level signal. In the first initialization stage, the first light emission control module is turned on under a control of an input signal of the first light emission control signal input terminal, and a high-level signal input into the first power voltage input terminal is transmitted to the first electrode of the drive transistor (that is, the first terminal of the drive module). The first initialization module is turned on under a control of an input signal of the control terminal of the first initialization module, and the first initialization module transmits a high-level signal input into the second light emission control signal input terminal or the initialization voltage input terminal to the gate electrode of the drive transistor (that is, the control terminal of the drive module). Further, in the first initialization stage, the potential of the gate electrode and the potential of the first electrode of the drive transistor are fixed, that is, the potential of the control terminal and the potential of the first terminal of the drive module are fixed, so that the complete reset of the drive transistor is achieved. Therefore, potentials of gate electrodes and potentials of source electrodes of drive transistors which drive light-emitting modules to display different gray scales in the previous frame are fixed. Drive transistors in various pixel circuits in the display panel including the pixel circuit have the same potential at gate electrodes and have the same potential at source electrodes in the first initialization stage. That is, drive transistors in a plurality of pixel circuits have the same working state. That is, drive transistors which drive light-emitting devices in the previous frame to display different gray scales in the first initialization stage can be restored to the same working state, so that the degrees of the capture and release of carries on active layers, gate electrode insulating layers and interfaces between the active layers and the gate electrode insulating layers of a plurality of drive transistors are basically the same. Therefore, when different gray scales are converted to the same gray scale, the magnitude of drive currents of the drive transistors are the same, the brightness of the corresponding light-emitting modules is the same, thus the phenomenon of residual shadow is improved, and the display effects are improved.

The embodiments of the present disclosure provide a pixel circuit. The pixel circuit includes a first initialization module, a first terminal of the first initialization module is electrically connected to a second light emission control signal input terminal or an initialization voltage input terminal, a second terminal of the first initialization module is electrically connected to a control terminal of a drive module, and the first initialization module is configured to initialize the control terminal of the drive module under a control of a control signal input into a control terminal of the first initialization module. A first light emission control module can be turned on under a control of an input signal of a first light emission control signal input terminal, and a high-level signal input into a first power voltage input terminal is transmitted to a first terminal of the drive module. Further, in a first initialization stage, the potential of the control terminal of the drive module and the potential of the first terminal of the drive module are fixed, drive modules in various pixel circuits in the display panel including the pixel circuit have the same potential at control terminals and have the same potential at first terminals in the first initialization stage. That is, drive modules in a plurality of pixel circuits have the same working state. In the case that the drive modules are drive transistors, drive transistors which drive light-emitting devices to display different gray scales in the previous frame can be restored to the same working state, so that the capture and release of carries on active layers, gate electrode insulating layers and interfaces between the active layers and the gate electrode insulating layers of a plurality of drive transistors are basically the same. Therefore, when different gray scales are converted to the same gray scale, the magnitude of drive currents is the same, the brightness of the light-emitting devices is the same, thus the phenomenon of residual shadow is improved, and the display effects are improved.

FIG. 1 is a structural diagram of a pixel circuit according to an embodiment of the disclosure. Referring to FIG. 1, the pixel circuit includes: a data-writing module 110, a drive module 120, a storage module 130, a first light emission control module 140, a second light emission control module 150, a light-emitting module 160 and a first initialization module 171.

A control terminal of the data-writing module 110 is electrically connected to a first scanning signal input terminal Scan1. A first terminal of the data-writing module 110 is electrically connected to a data voltage input terminal Vdata of the pixel circuit. A second terminal of the data-writing module 110 is electrically connected to a control terminal of the drive module 120.

A first terminal of the drive module 120 is electrically connected to a second terminal of the first light emission control module 140. A second terminal of the drive module 120 is electrically connected to a first terminal of the second light emission control module 150.

A control terminal of the first light emission control module 140 is electrically connected to a first light emission control signal input terminal EM1. A first terminal of the first light emission control module 140 is electrically connected to a first power voltage input terminal Vdd.

A control terminal of the second light emission control module 150 is electrically connected to a second light emission control signal input terminal EM2. A second terminal of the second light emission control module 150 is electrically connected to a first terminal of the light-emitting module 160, and a second terminal of the light-emitting module 160 is electrically connected to a second power voltage input terminal Vss.

A control terminal of the first initialization module 171 is electrically connected to a second scanning signal input terminal Scan2 of the pixel circuit. A first terminal of the first initialization module 171 is electrically connected to the second light emission control signal input terminal EM2. A second terminal of the first initialization module 171 is electrically connected to the control terminal of the drive module 120.

Figure 2:
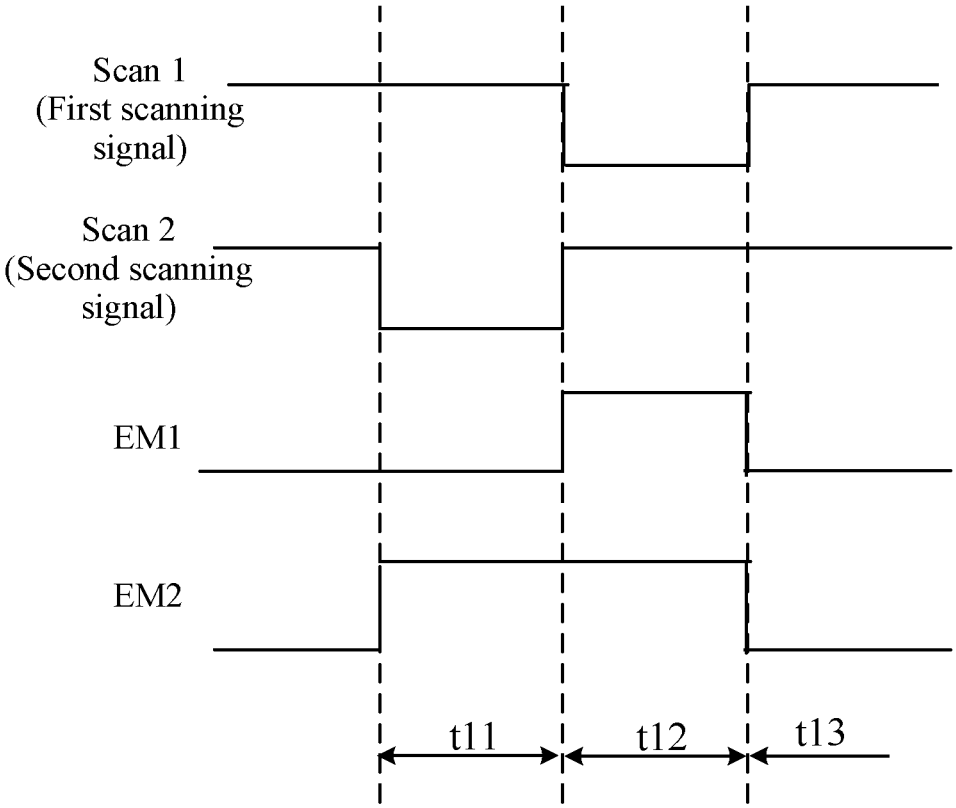
FIG. 2 is a working time sequence diagram applicable to the pixel circuit shown in FIG. 1 according to an embodiment of the present disclosure.

FIG. 2 is a working time sequence diagram of a pixel circuit according to an embodiment of the present disclosure. The working time sequence shown in FIG. 2 may be applicable to the pixel circuit shown in FIG. 1. Referring to FIG. 1 and FIG. 2, the working process of the pixel circuit includes a first initialization stage t11, a data-writing stage t12 and a light emission stage t13. The signal input into the first power voltage input terminal Vdd being a high-level signal and the signal input into the second power voltage input terminal Vss being a low-level signal are taken as an example for description, and each module in the pixel circuit being turned on by a low-level signal input into the control terminal of the each module is taken as an example for description.

In the first initialization stage t11, a low-level signal is input into the second scanning signal input terminal Scan2, the first initialization module 171 is turned on. A high-level signal input into the second light emission control signal input terminal EM2 is transmitted to the control terminal of the drive module 120 through the first initialization module 171 which is turned on. A low-level signal is input into the first light emission control signal input terminal EM1, and the first light emission control module 140 is turned on and transmits a high-level signal input by the first power voltage input terminal Vdd to the first terminal of the drive module 120. That is, in the first initialization stage, the potential of the control terminal and the potential of the first terminal of the drive module 120 are fixed, and the complete reset of the drive module 120 is achieved.

In the data-writing stage t12, a low-level signal is input into the first scanning signal input terminal Scan1, the data-writing module 110 is turned on. A data voltage input into the data voltage input terminal Vdata is transmitted to the control terminal of the drive module 120 through the data-writing module 110 which is turned on. The storage module 130 stores the potential between the control terminal of the drive module 120 and the first terminal of the drive module 120.

In the light emission stage t13, a low-level signal is input into the first light emission control signal input terminal EM1 and the second light emission control signal input terminal EM2. The first light emission control module 140 and the second light emission control module 150 are turned on, and the drive module 120 drives the light-emitting module 160 to emit light.

Figure 3:
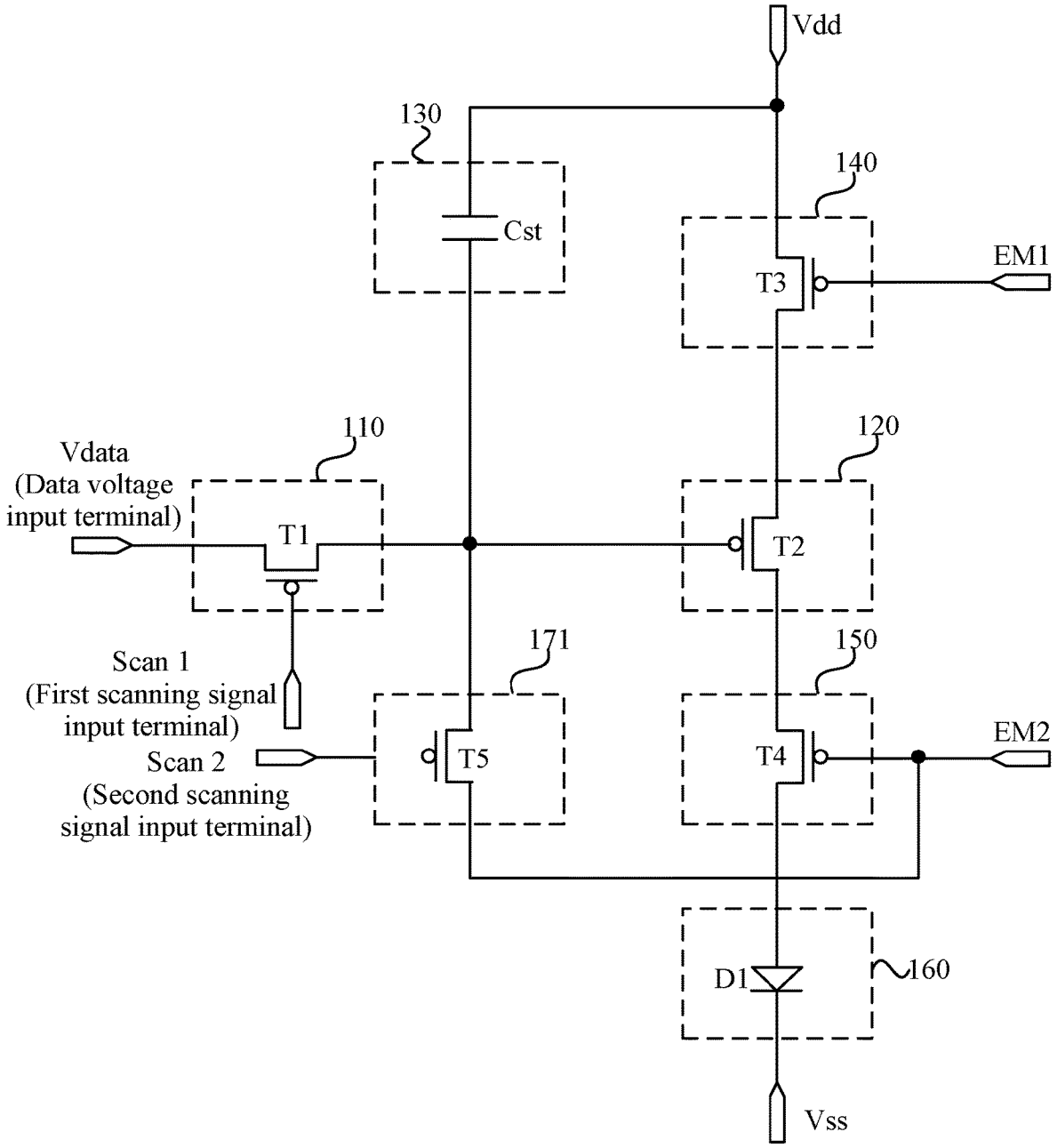
FIG. 3 is a structural diagram of another pixel circuit according to an embodiment of the present disclosure.

FIG. 3 is a structural diagram of another pixel circuit according to an embodiment of the present disclosure. The pixel circuit shown in FIG. 3 may correspond to the pixel circuit shown in FIG. 1 whose modules are subdivided into specific components. Referring to FIG. 3, in an embodiment, the data-writing module 110 includes a first transistor T1, the drive module 120 includes a second transistor T2, the first light emission control module 140 includes a third transistor T3, the second light emission control module 150 includes a fourth transistor T4, the first initialization module 171 includes a fifth transistor T5, the storage module 130 includes a storage capacitor Cst, and the light-emitting module 160 includes an organic light-emitting device D1.

A gate electrode of the first transistor T1 is electrically connected to the first scanning signal input terminal Scan1. A first electrode of the first transistor T1 is electrically connected to the data voltage input terminal Vdata of the pixel circuit. A second electrode of the first transistor T1 is electrically connected to a gate electrode of the second transistor T2.

A first electrode of the second transistor T2 is electrically connected to a second electrode of the third transistor T3. A second electrode of the second transistor T2 is electrically connected to a first electrode of the fourth transistor T4.

A gate electrode of the third transistor T3 is electrically connected to the first light emission control signal input terminal EM1. A first electrode of the third transistor T3 is electrically connected to the first power voltage input terminal Vdd.

A gate electrode of the fourth transistor T4 is electrically connected to the second light emission control signal input terminal EM2, a second electrode of the fourth transistor T4 is electrically connected to a first electrode of the organic light-emitting device D1, and a second electrode of the organic light-emitting device D1 is connected to the second power voltage input terminal Vss.

A gate electrode of the fifth transistor T5 is electrically connected to the second scanning signal input terminal Scan2 of the pixel circuit, a first electrode of the fifth transistor T5 is electrically connected to the second light emission control signal input terminal EM2, and a second electrode of the fifth transistor T5 is electrically connected to the gate electrode of the second transistor T2.

The working time sequence shown in FIG. 2 is also applicable to the pixel circuit shown in FIG. 3. Moreover, the turned-on or turned-off state of the first transistor T1 in FIG. 3 is the same as the turned-on or turn-off state of the data-writing module 110 in FIG. 1. The turned-on or turned-off state of the second transistor T2 in FIG. 3 is the same as the turned-on or turn-off state of the drive module 120 in FIG. 1. The turned-on or turned-off state of the third transistor T3 in FIG. 3 is the same as the turned-on or turn-off state of the first light emission control module 140 in FIG. 1. The turned-on or turned-off state of the fourth transistor T4 in FIG. 3 is the same as the turned-on or turn-off state of the second light emission control module 150 in FIG. 1. The turned-on or turned-off state of the fifth transistor T5 in FIG. 3 is the same as the turned-on or turn-off state of the first initialization module 171 in FIG. 1, which is not repeated herein.

For the pixel circuit provided in the embodiment, in the first initialization stage t11, a fixed potential is written to the control terminal and the first terminal of the drive module 120 respectively, so that the drive module 120 is completely reset in the first initialization stage t11, and drive modules 120 which drive light-emitting modules 160 to display different gray scales in the previous frame have the same initial working state. In the case that drive modules 120 are drive transistors, the degrees of the capture and release of carriers within the drive transistors are basically the same, so that drive currents generated by the drive modules 120 are the same, and the brightness of the corresponding light-emitting modules 160 is the same, thereby the phenomenon of residual shadow is improved, and the display effects are improved.

Figure 4:
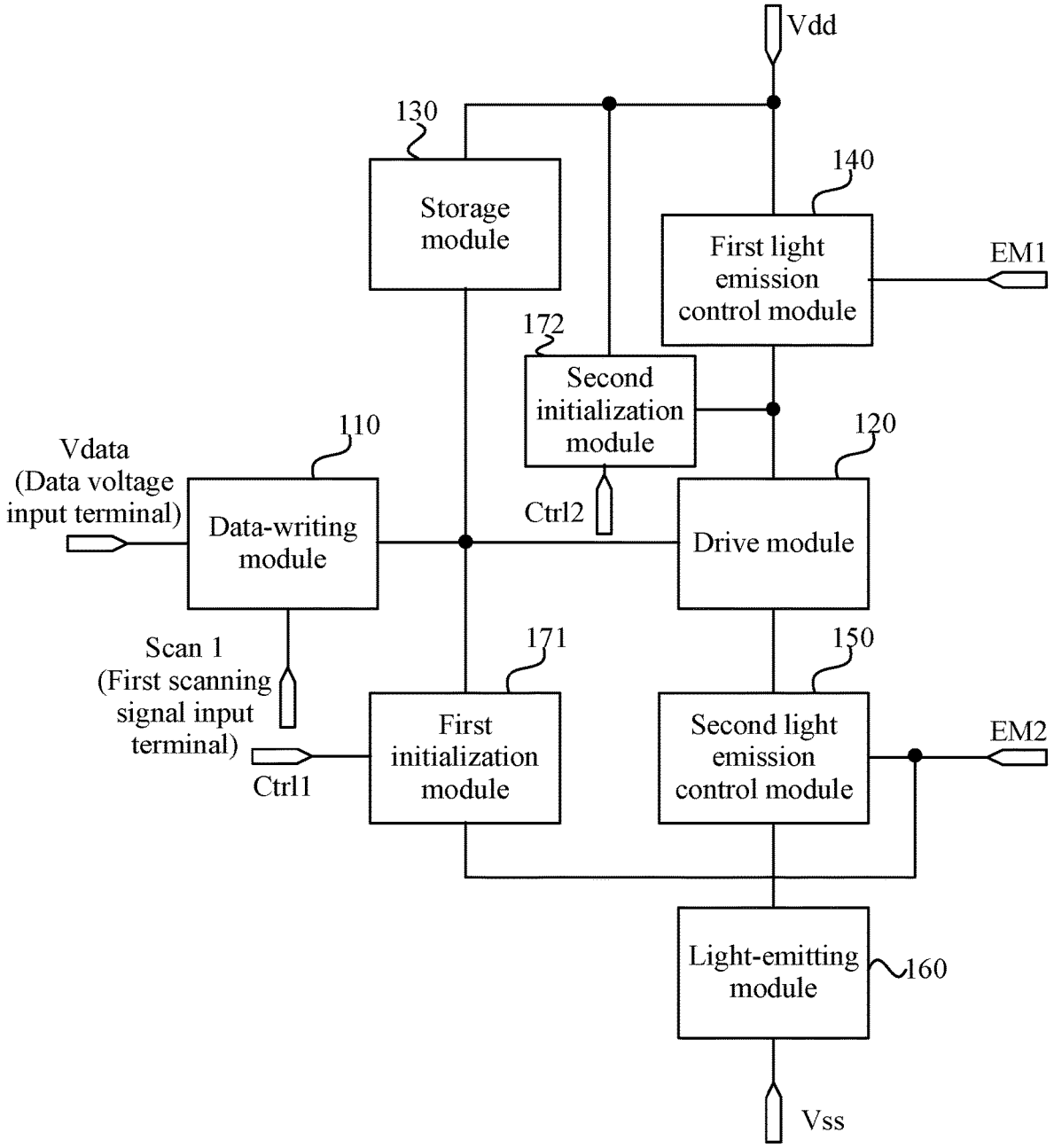
FIG. 4 is a structural diagram of another pixel circuit according to an embodiment of the present disclosure.

FIG. 4 is a structural diagram of another pixel circuit according to an embodiment of the present disclosure. Referring to FIG. 4, in an embodiment, the pixel circuit further includes: a second initialization module 172. The second initialization module 172 includes a control terminal, a first terminal and a second terminal. The first terminal of the second initialization module 172 is electrically connected to the first power voltage input terminal Vdd. The second terminal of the second initialization module 172 is electrically connected to the first terminal of the drive module 120. The second initialization module 172 is configured to initialize the first terminal of the drive module 120 under a control of an input signal of the control terminal of the second initialization module 172.

Figure 5:
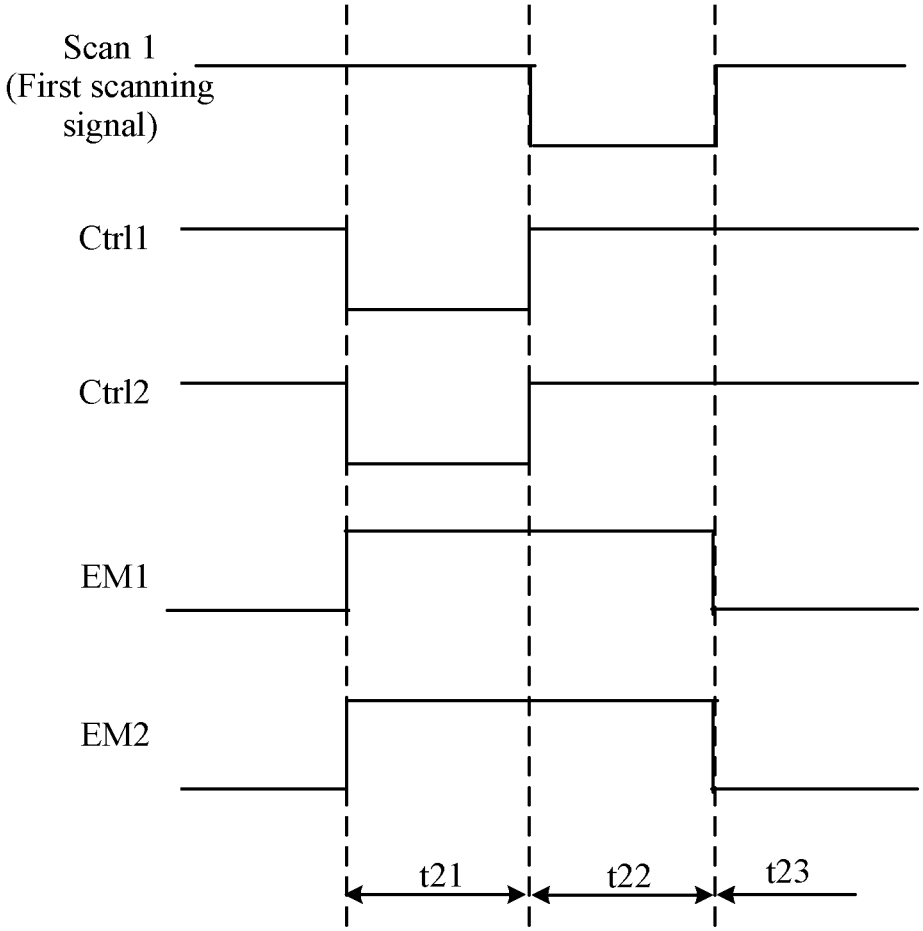
FIG. 5 is another working time sequence diagram applicable to the pixel circuit shown in FIG. 4 according to an embodiment of the present disclosure.

FIG. 5 is a working time sequence diagram of another pixel circuit according to an embodiment of the present disclosure. The working time sequence shown in FIG. 5 may be applicable to the pixel circuit shown in FIG. 4. Referring to FIG. 4 and FIG. 5, the working process of the pixel circuit may include a first initialization stage t21, a data-writing stage t22 and a light emission stage t23. FIG. 4 shows an example in which the control terminal of the first initialization module 171 is connected to a first control signal input terminal Ctrl1. The control terminal of the second initialization module 172 is connected to a second control signal input terminal Ctrl2. The signal input into the first power voltage input terminal Vdd being a high-level signal and the signal input into the second power voltage input terminal Vss being a low-level signal are taken as an example for description in embodiments described below, and each module in the pixel circuit being turned on by a low-level signal input into the control terminal of the each module is taken as an example for description.

In the first initialization stage t21, a low-level signal is input into the first control signal input terminal Ctrl1. The first initialization module 171 is turned on. A high-level signal input into the second light emission control signal input terminal EM2 is transmitted to the control terminal of the drive module 120. A low-level signal is input into the second control signal input terminal Ctrl2. The second initialization module 172 is turned on and transmits a high-level signal input into the first power voltage input terminal Vdd to the first terminal of the drive module 120.

Therefore, the complete reset of the drive module 120 is achieved in the first initialization stage, which is beneficial to improving the phenomenon of residual shadow.

In the data-writing stage t22, a low-level signal is input into the first scanning signal input terminal Scan1, and the data-writing module 110 is turned on. A data voltage input into the data voltage input terminal Vdata is transmitted to the control terminal of the drive module 120 through the data-writing module 110 which is turned on, and the storage module 130 stores the potential between the control terminal of the drive module 120 and the first terminal of the drive module 120.

In the light emission stage t23, a low-level signal is input into the first light emission control signal input terminal EM1 and the second light emission control signal input terminal EM2. The first light emission control module 140 and the second light emission control module 150 are turned on. The drive module 120 drives the light-emitting module 160 to emit light.

Figure 6:
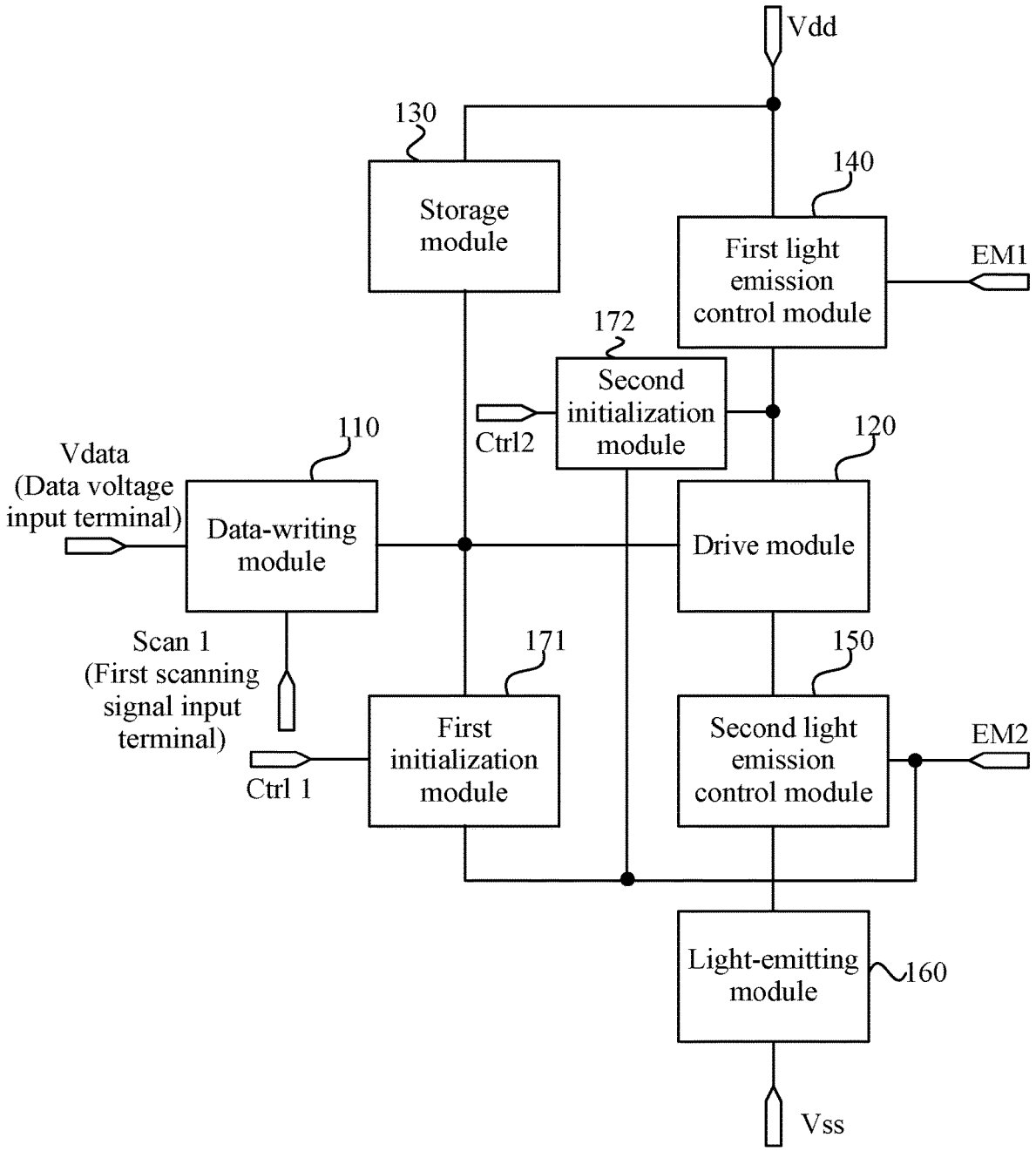
FIG. 6 is a structural diagram of another pixel circuit according to an embodiment of the present disclosure.

FIG. 6 is a structural diagram of another pixel circuit according to an embodiment of the present disclosure. Referring to FIG. 6, in an embodiment, the pixel circuit further includes: a second initialization module 172; the second initialization module 172 includes a control terminal, a first terminal and a second terminal. The first terminal of the second initialization module 172 is electrically connected to the second light emission control signal input terminal EM2, and the second terminal of the second initialization module 172 is electrically connected to the first terminal of the drive module 120. The second initialization module 172 is configured to initialize the first terminal of the drive module 120 under a control of an input signal of the control terminal of the second initialization module 172.

The working time sequence shown in FIG. 5 is also applicable to the pixel circuit shown in FIG. 6. Referring to FIG. 5 and FIG. 6, in the first initialization stage, a low-level signal is input into the first control signal input terminal Ctrl1, and the first initialization module 171 is turned on and transmits a high-level signal input into the second light emission control signal input terminal to the control terminal of the drive module 120. A low-level signal is input into the second control signal input terminal Ctrl2, and the second initialization module 172 is turned on and transmits a high-level signal input into the second light emission control signal input terminal EM2 to the first terminal of the drive module 120. Therefore, the complete reset of the drive module 120 is achieved in the first initialization stage, which is beneficial to improving the phenomenon of residual shadow.

In the data-writing stage t22, a low-level signal is input into the first scanning signal input terminal Scan1, and the data-writing module 110 is turned on. A data voltage input into the data voltage input terminal Vdata is transmitted to the control terminal of the drive module 120 through the data-writing module 110 which is turned on, and the storage module 130 stores the potential between the control terminal of the drive module 120 and the first terminal of the drive module 120.

In the light emission stage t23, a low-level signal is input into the first light emission control signal input terminal EM1 and the second light emission control signal input terminal EM2, the first light emission control module 140 and the second light emission control module 150 are turned on, and the drive module 120 drives the light-emitting module 160 to emit light.

Figure 7:
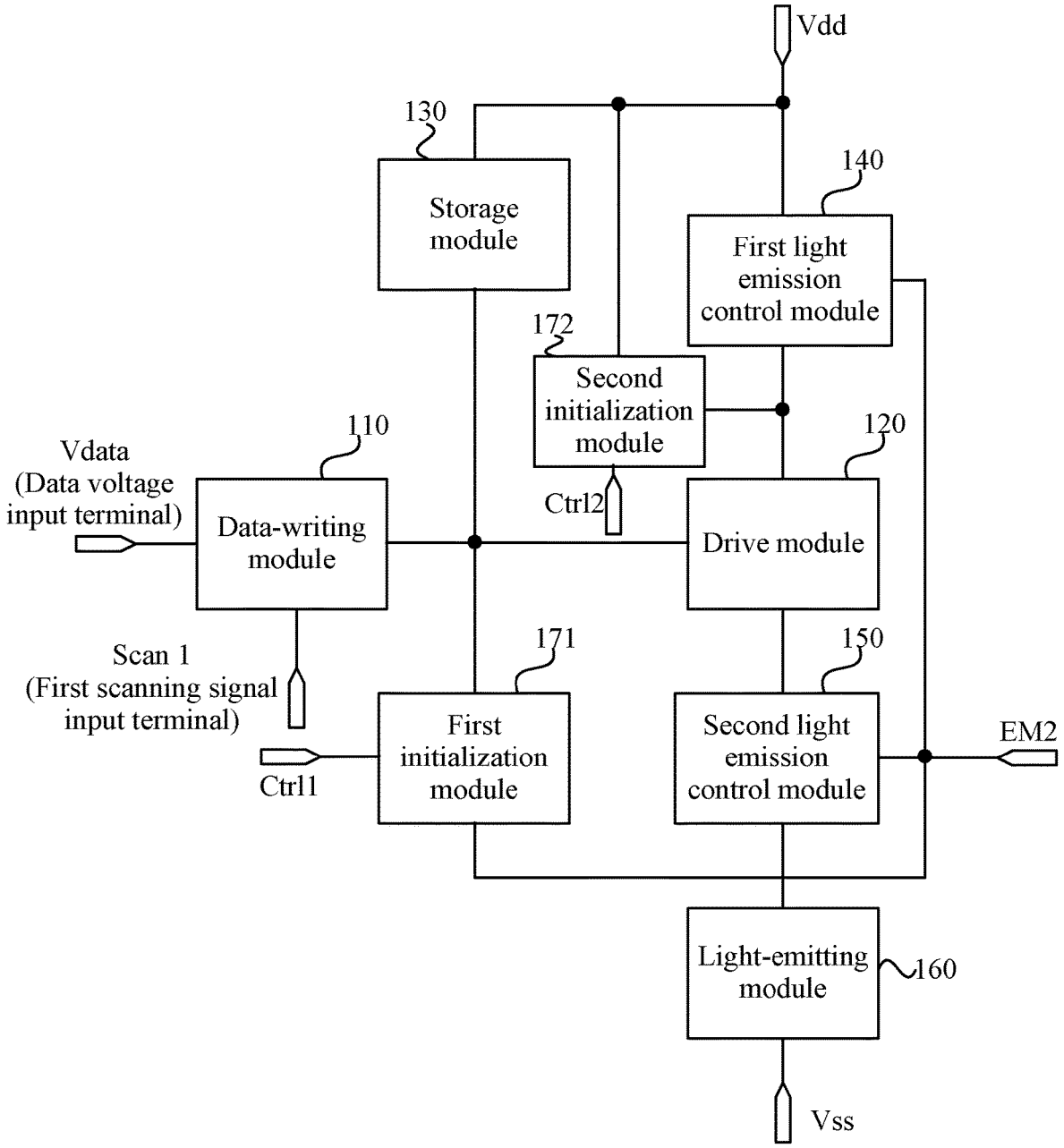
FIG. 7 is a structural diagram of another pixel circuit according to an embodiment of the present disclosure.

FIG. 7 is a structural diagram of another pixel circuit according to an embodiment of the present disclosure. Referring to FIG. 7, in an embodiment, the first terminal of the first initialization module 171 is electrically connected to the second light emission control signal input terminal EM2, and the second terminal of the first initialization module 171 is electrically connected to the control terminal of the drive module 120. The first light emission control signal input terminal EM1 and the second light emission control signal input terminal EM2 are the same input terminal.

In an embodiment, according to the working time sequence of the pixel circuit shown in FIG. 5, it can be seen that the time sequence of the signal input into the first light emission control signal input terminal EM1 is the same as the time sequence of the signal input into the second light emission control signal input terminal EM2. Therefore, the first light emission control signal input terminal EM1 of the pixel circuit and the second light emission control signal input terminal EM2 of the pixel circuit may be configured as a common input terminal (FIG. 7 shows an example in which the control terminal of the first light emission control module 140 and the control terminal of the second light emission control module 150 are both electrically connected to the second light emission control signal input terminal EM2). Therefore, in the display panel including the pixel circuit, the common input terminal can be connected to one light emission control signal line, thus the number of wirings in the display panel is reduced, the wiring of the display panel is simplified, and the pixel density is improved.

Figure 8:
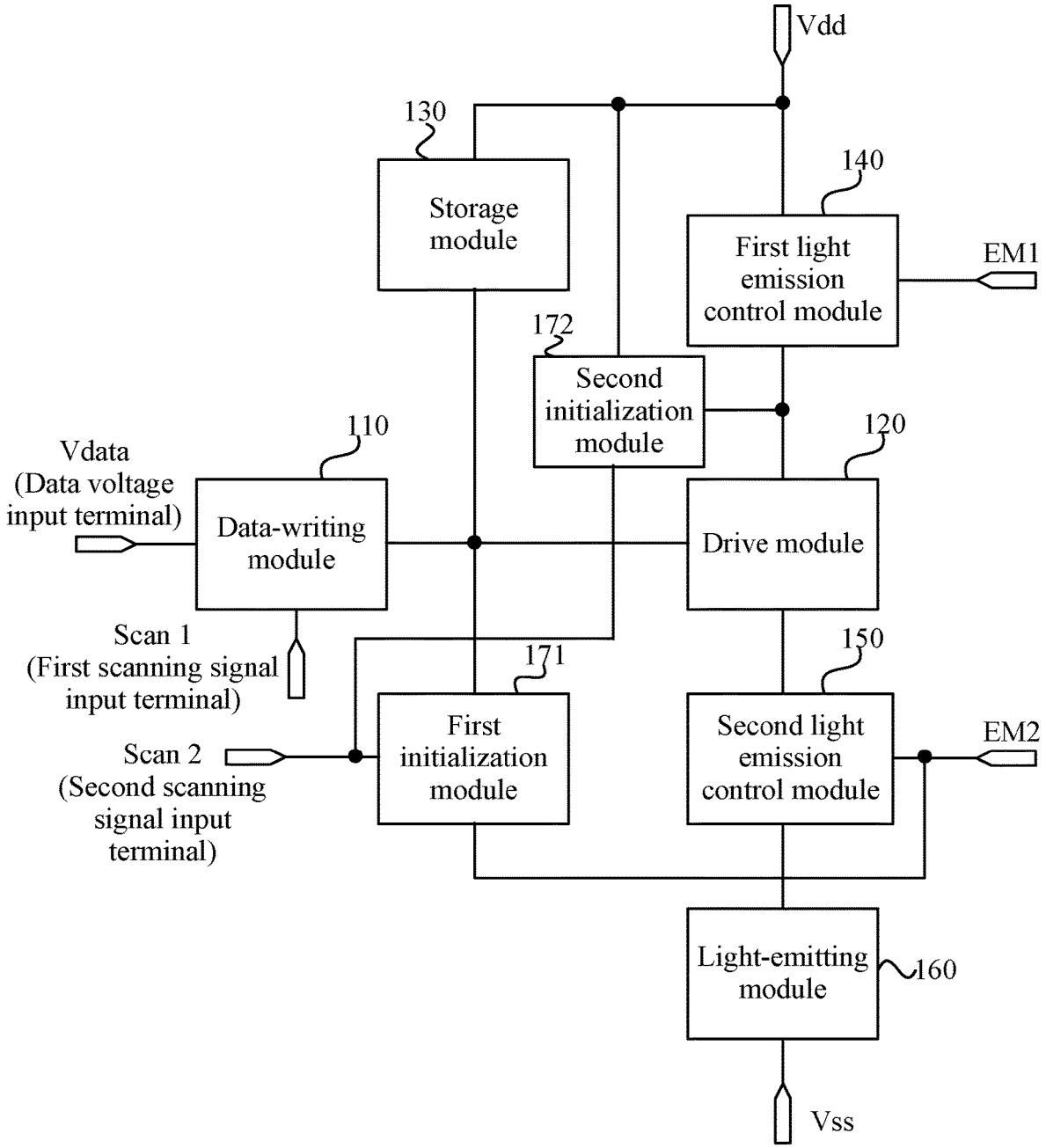
FIG. 8 is a structural diagram of another pixel circuit according to an embodiment of the present disclosure.

FIG. 8 is a structural diagram of another pixel circuit according to an embodiment of the present disclosure.

Referring to FIG. 8, in an embodiment, the first terminal of the first initialization module 171 is electrically connected to the second light emission control signal input terminal EM2. The second terminal of the first initialization module 171 is electrically connected to the control terminal of the drive module 120. The pixel circuit further includes a second scanning signal input terminal Scan2, and the control terminal of the first initialization module 171 and the control terminal of the second initialization module 172 are both electrically connected to the second scanning signal input terminal Scan2.

According to the working time sequence of the pixel circuit shown in FIG. 4, the working time sequence of the pixel circuit shown in FIG. 6 and the working time sequence of the pixel circuit shown in FIG. 5, it can be seen that the first control signal input terminal Ctrl1 connected to the control terminal of the first initialization module 171 and the second control signal input terminal Ctrl2 connected to the control terminal of the second initialization module 172 have the same time sequence of the signal, so that the control terminal of the first initialization module 171 and the control terminal of the second initialization module 172 may be connected to the same signal input terminal, that is, are both connected to the second scanning signal input terminal Scan2. Therefore, in the display panel including the pixel circuit, the control terminal of the first initialization module 171 of the pixel circuit and the control terminal of the second initialization module 172 of the pixel circuit can be connected to one scan line, thus the number of wirings in the display panel is reduced, the wiring of the display panel is simplified, and the pixel density is improved.

It should be noted that FIG. 8 only illustratively shows an example in which the first control signal input terminal Ctrl1 connected to the control terminal of the first initialization module 171 and the second control signal input terminal Ctrl2 connected to the control terminal of the second initialization module 172 of the pixel circuit shown in FIG. 4 are combined into the second scanning signal input terminal Scan2. The first control signal input terminal Ctrl1 connected to the control terminal of the first initialization module 171 and the second control signal input terminal Ctrl2 connected to the control terminal of the second initialization module 172 of the pixel circuit shown in FIG. 6 can also be combined into the second scanning signal input terminal Scan2, which is not shown herein.

Figure 9:
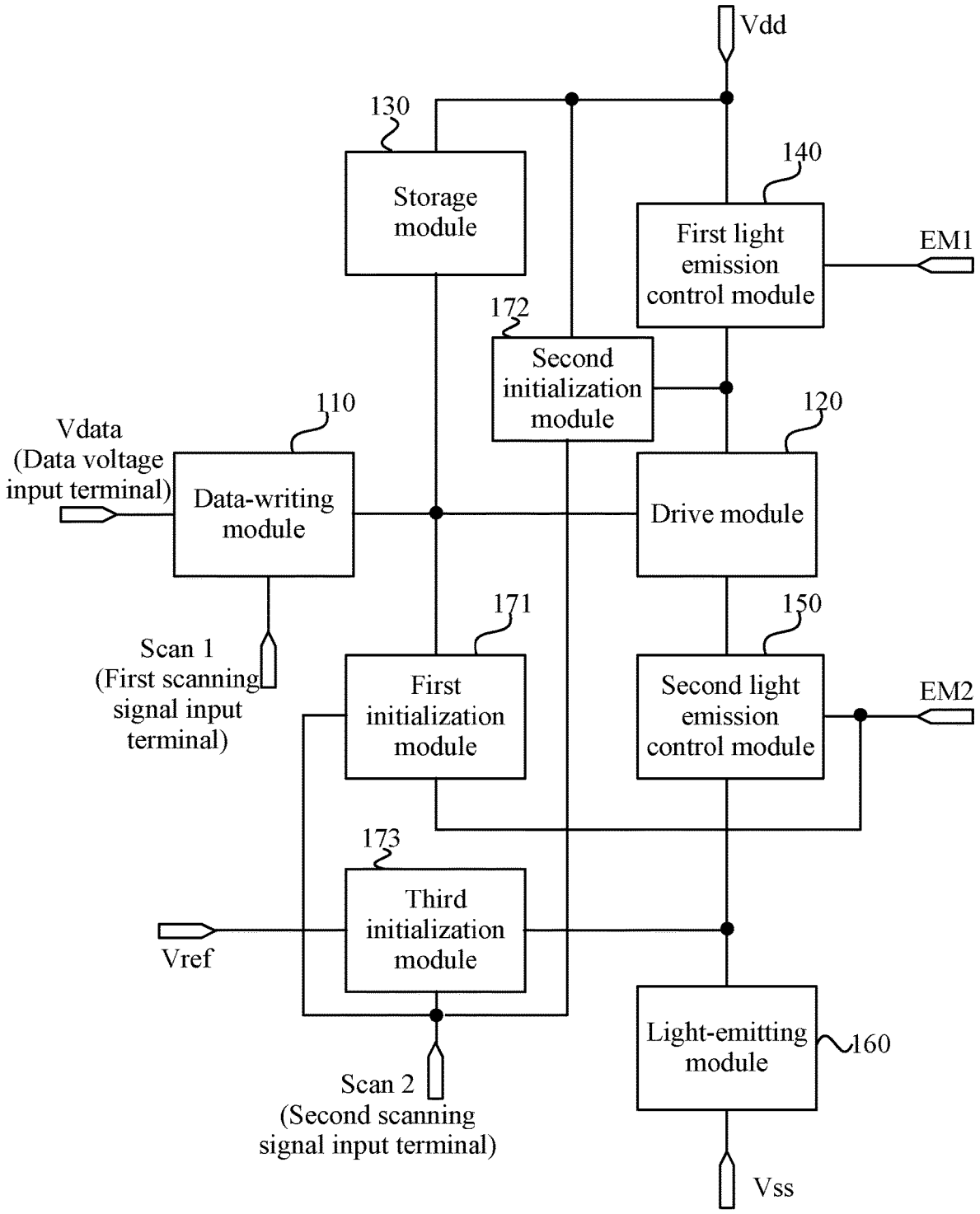
FIG. 9 is a structural diagram of another pixel circuit according to an embodiment of the present disclosure.

FIG. 9 is a structural diagram of another pixel circuit according to an embodiment of the present disclosure. Referring to FIG. 9, in an embodiment, the pixel circuit further includes a third initialization module 173. A control terminal of the third initialization module 173 is electrically connected to the second scanning signal input terminal Scan2, a first terminal of the third initialization module 173 is electrically connected to an initialization voltage input terminal Vref of the pixel circuit, and a second terminal of the third initialization module 173 is electrically connected to the first terminal of the light-emitting module 160.

Figure 10:
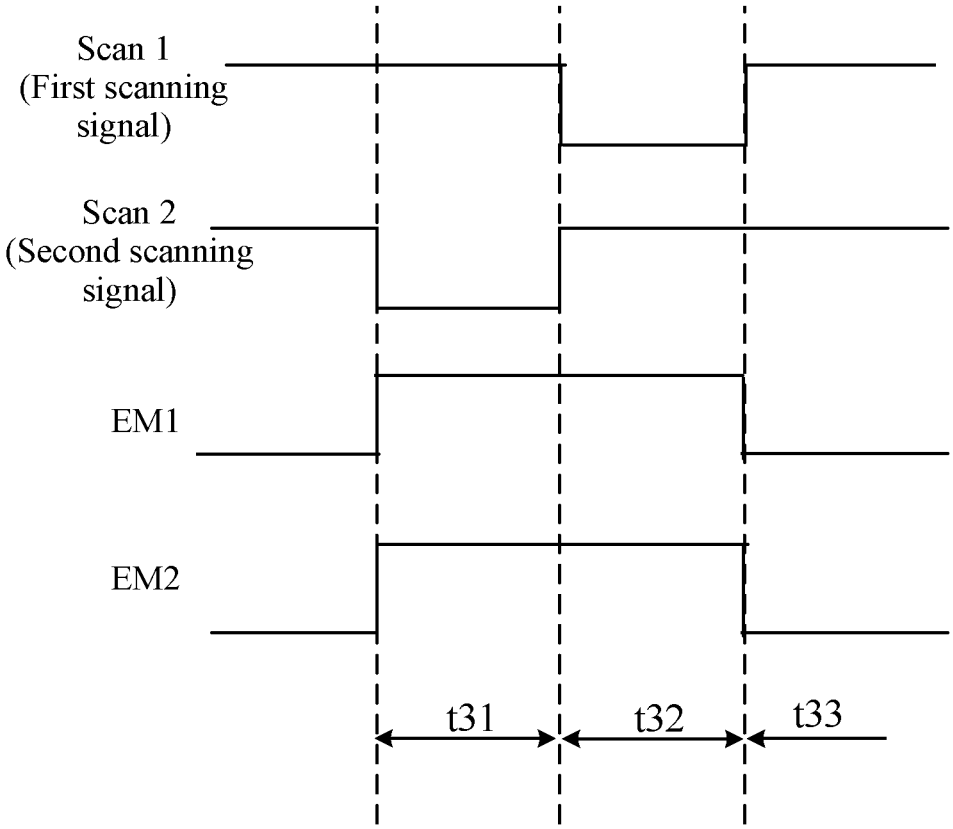
FIG. 10 is another working time sequence diagram applicable to the pixel circuit shown in FIG. 9 according to an embodiment of the present disclosure.

FIG. 10 is another working time sequence diagram applicable to the pixel circuit shown in FIG. 9 according to an embodiment of the present disclosure. Referring to FIG. 9 and FIG. 10, the working process of the pixel circuit shown in FIG. 9 may include a first initialization stage t31, a data-writing stage t32 and a light emission stage t33.

In the first initialization stage t31, a low-level signal is input into the second scanning signal input terminal Scan2; the first initialization module 171, the second initialization module 172 and the third initialization module 173 are turned on; a high-level signal input into the second light emission control signal input terminal EM2 is transmitted to the first terminal of the drive transistor through the first initialization module 171 which is turned on, and a high-level signal input into the first power voltage input terminal Vdd is transmitted to the first terminal of the drive module 120 through the second initialization module 172 which is turned on. Therefore, the complete reset of the drive module 120 is achieved, which is beneficial to improving the phenomenon of residual shadow. An initialization voltage input into the initialization voltage input terminal Vref is transmitted to the first terminal of the light-emitting module 160, and then the first terminal of the light-emitting module 160 is reset, so that the charge remained from the previous frame at the first terminal of the light-emitting module 160 is prevented from interfering with the display of the current frame, and the display effects are improved.

In the data-writing stage t32, a low-level signal is input into the first scanning signal input terminal Scan1, the data-writing module 110 is turned on, a data voltage input into the data voltage input terminal Vdata is transmitted to the control terminal of the drive module 120 through the data-writing module 110 which is turned on, and the storage module 130 stores the potential between the control terminal of the drive module 120 and the first terminal of the drive module 120.

In the light emission stage t33, a low-level signal is input into the first light emission control signal input terminal EM1 and the second light emission control signal input terminal EM2, the first light emission control module 140 and the second light emission control module 150 are turned on, and the drive module 120 drives the light-emitting module 160 to emit light.

Figure 11:
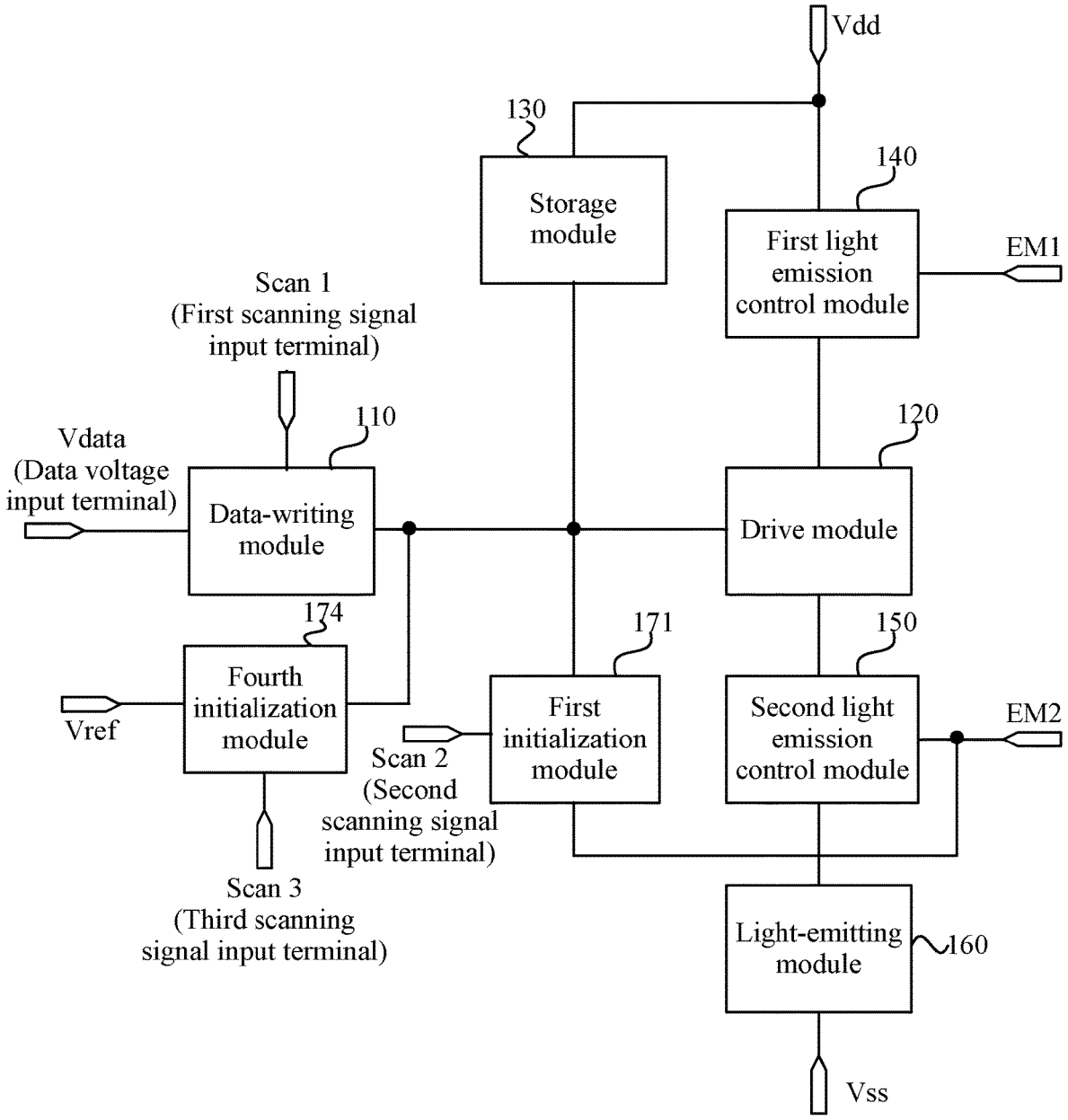
FIG. 11 is a structural diagram of another pixel circuit according to an embodiment of the present disclosure.

FIG. 11 is a structural diagram of another pixel circuit according to an embodiment of the present disclosure. Referring to FIG. 11, in an embodiment, the pixel circuit further includes a fourth initialization module 174. A control terminal of the fourth initialization module 174 is electrically connected to a third scanning signal input terminal Scan3 of the pixel circuit, a first terminal of the fourth initialization module 174 is electrically connected to the initialization voltage input terminal Vref of the pixel circuit, and a second terminal of the fourth initialization module 174 is electrically connected to the control terminal of the drive module 120.

Figure 12:
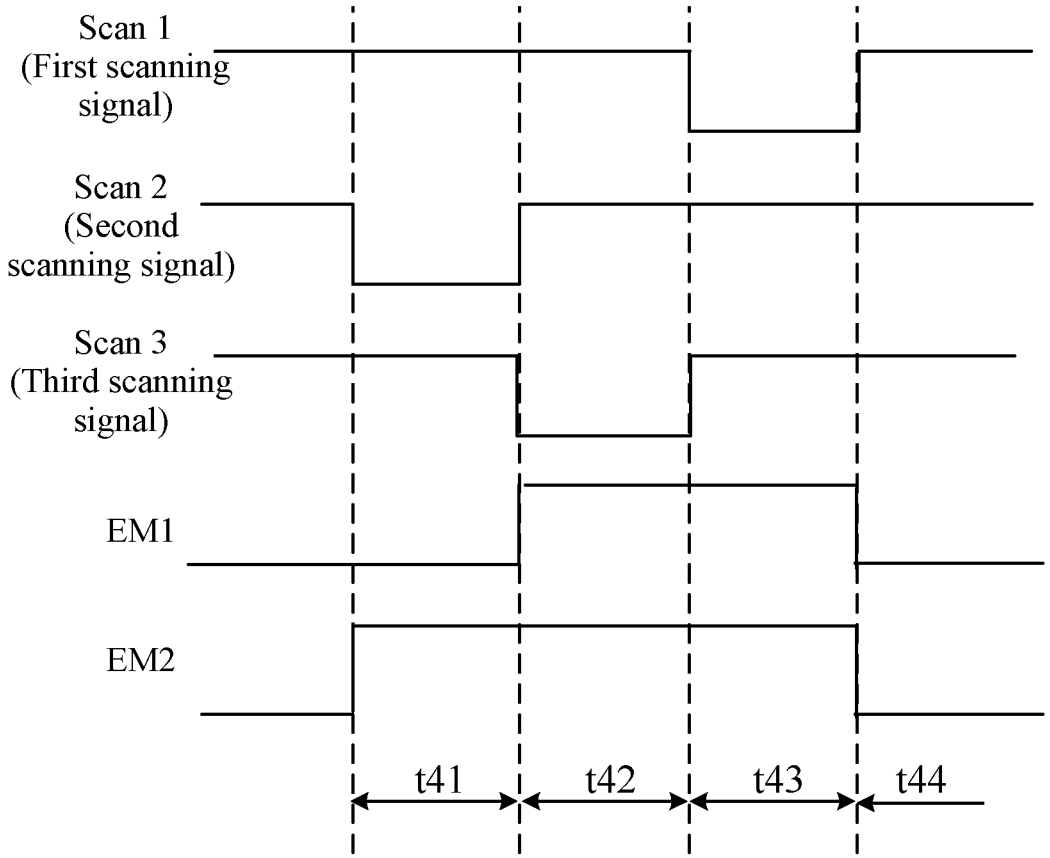
FIG. 12 is another working time sequence diagram applicable to the pixel circuit shown in FIG. 11 according to an embodiment of the present disclosure.

FIG. 12 is another working time sequence diagram applicable to the pixel circuit shown in FIG. 11 according to an embodiment of the present disclosure. Referring to FIG. 11 and FIG. 12, the working process of the pixel circuit shown in FIG. 11 may include a first initialization stage t41, a second initialization stage t42, a data-writing stage t43 and a light emission stage t44.

In the first initialization stage t41, a low-level signal is input into the second scanning signal input terminal Scan2, the first initialization module 171 is turned on, and a high-level signal input into the second light emission control signal input terminal EM2 is transmitted to the control terminal of the drive module 120 through the first initialization module 171 which is turned on. A low-level signal is input into the first light emission control signal input terminal EM1, and the first light emission control module 140 is turned on and transmits a high-level signal input into the first power voltage input terminal Vdd to the first terminal of the drive module 120. That is, in the first initialization stage, the potential of the control terminal of the drive module 120 and the potential of the first terminal of the drive module 120 are fixed, and the complete reset of the drive module 120 is achieved.

In the second initialization stage t42, a low-level signal is input into the third scanning signal input terminal Scan3, the fourth initialization module 174 is turned on, and an initialization voltage input into the initialization voltage input terminal Vref is transmitted to the control terminal of the drive transistor through the fourth initialization module 174 which is turned on. The initialization voltage is less than a high-level signal input into the second light emission control signal input terminal EM2, and the initialization voltage may be less than the data voltage corresponding to any gray scale. Therefore, before the data-writing stage, a relatively-low-level voltage is written to the initialization voltage input terminal Vref, so that the data voltage is more easily written to the control terminal of the drive module 120 during the data-writing stage.

In the data-writing stage t43, a low-level signal is input into the first scanning signal input terminal Scan1, the data-writing module 110 is turned on, a data voltage input into the data voltage input terminal Vdata is transmitted to the control terminal of the drive module 120 through the data-writing module 110 which is turned on, and the storage module 130 stores the potential between the control terminal of the drive module 120 and the first terminal of the drive module 120.

In the light emission stage t44, a low-level signal is input into the first light emission control signal input terminal EM1 and the second light emission control signal input terminal EM2, the first light emission control module 140 and the second light emission control module 150 are turned on, and the drive module 120 drives the light-emitting module 160 to emit light.

Figure 13:
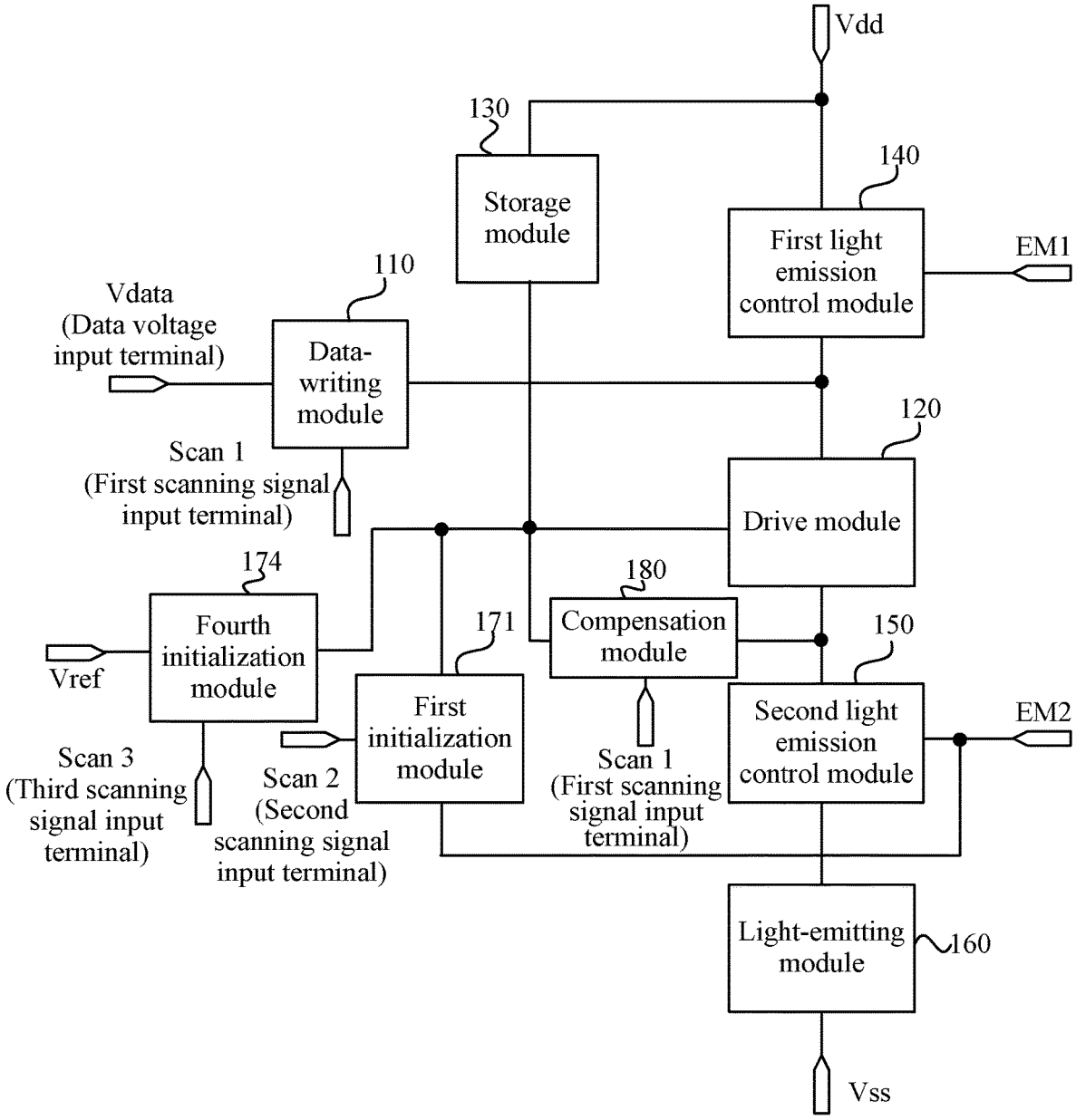
FIG. 13 is a structural diagram of another pixel circuit according to an embodiment of the present disclosure.

FIG. 13 is a structural diagram of another pixel circuit according to an embodiment of the present disclosure. Referring to FIG. 13, in an embodiment, the control terminal of the data-writing module 110 is electrically connected to the first scanning signal input terminal Scan1, the first terminal of the data-writing module 110 is electrically connected to the data voltage input terminal Vdata, and the second terminal of the data-writing module 110 is electrically connected to the first terminal of the drive module 120; and a first terminal of the storage module 130 is electrically connected to the control terminal of the drive module 120, and a second terminal of the storage module 130 is electrically connected to the first power voltage input terminal Vdd.

The pixel circuit further includes a compensation module 180. A control terminal of the compensation module 180 and the control terminal of the data-writing module 110 are both electrically connected to the first scanning signal input terminal Scan1 of the pixel circuit, a first terminal of the compensation module 180 is electrically connected to the second terminal of the drive module 120, and a second terminal of the compensation module 180 is electrically connected to the control terminal of the drive module 120.

The working time sequence shown in FIG. 12 is also applicable to the pixel circuit shown in FIG. 13. Referring to FIG. 12 and FIG. 13, the working process of the pixel circuit shown in FIG. 13 may include a first initialization stage t41, a second initialization stage t42, a data-writing stage t43 and a light emission stage t44.

In the first initialization stage t41, a low-level signal is input into the second scanning signal input terminal Scan2, the first initialization module 171 is turned on, and a high-level signal input into the second light emission control signal input terminal EM2 is transmitted to the control terminal of the drive module 120 through the first initialization module 171 which is turned on; a low-level signal is input into the first light emission control signal input terminal EM1, and the first light emission control module 140 is turned on and transmits a high-level signal input into the first power voltage input terminal Vdd to the first terminal of the drive module 120. That is, in the first initialization stage, the potential of the control terminal and the potential of the first terminal of the drive module 120 are fixed, and the complete reset of the drive module 120 is achieved.

In the second initialization stage t42, a low-level signal is input into the third scanning signal input terminal Scan3, the fourth initialization module 174 is turned on, and an initialization voltage input into the initialization voltage input terminal Vref is transmitted to the control terminal of the drive transistor through the fourth initialization module 174 which is turned on. The initialization voltage is less than a high-level signal input into the second light emission control signal input terminal EM2 (that is, the input terminal of the second light emission control module 150). The initialization voltage may be less than the data voltage corresponding to any gray scale. Therefore, before the data-writing stage, a relatively-low-level voltage is written to the initialization voltage input terminal Vref, so that the data voltage is more easily written to the control terminal of the drive module 120 during the data-writing stage.

In the data-writing stage t43, a low-level signal is input into the first scanning signal input terminal Scan1, the data-writing module 110 and the compensation module 180 are turned on, a data voltage input into the data voltage input terminal Vdata is written to the control terminal of the drive module 120 through the data-writing module 110, the drive module 120 and the compensation module 180 which are turned on, so that the writing of the data voltage is achieved. In the case that the drive module 120 is a drive transistor, the compensation for the threshold voltage of the drive transistor can be achieved in this stage, so that the drive current is not affected by the threshold voltage.

In the light emission stage t44, a low-level signal is input into the first light emission control signal input terminal EM1 and the second light emission control signal input terminal EM2, and the drive module 120 drives the light-emitting module 160 to emit light.

Figure 14:
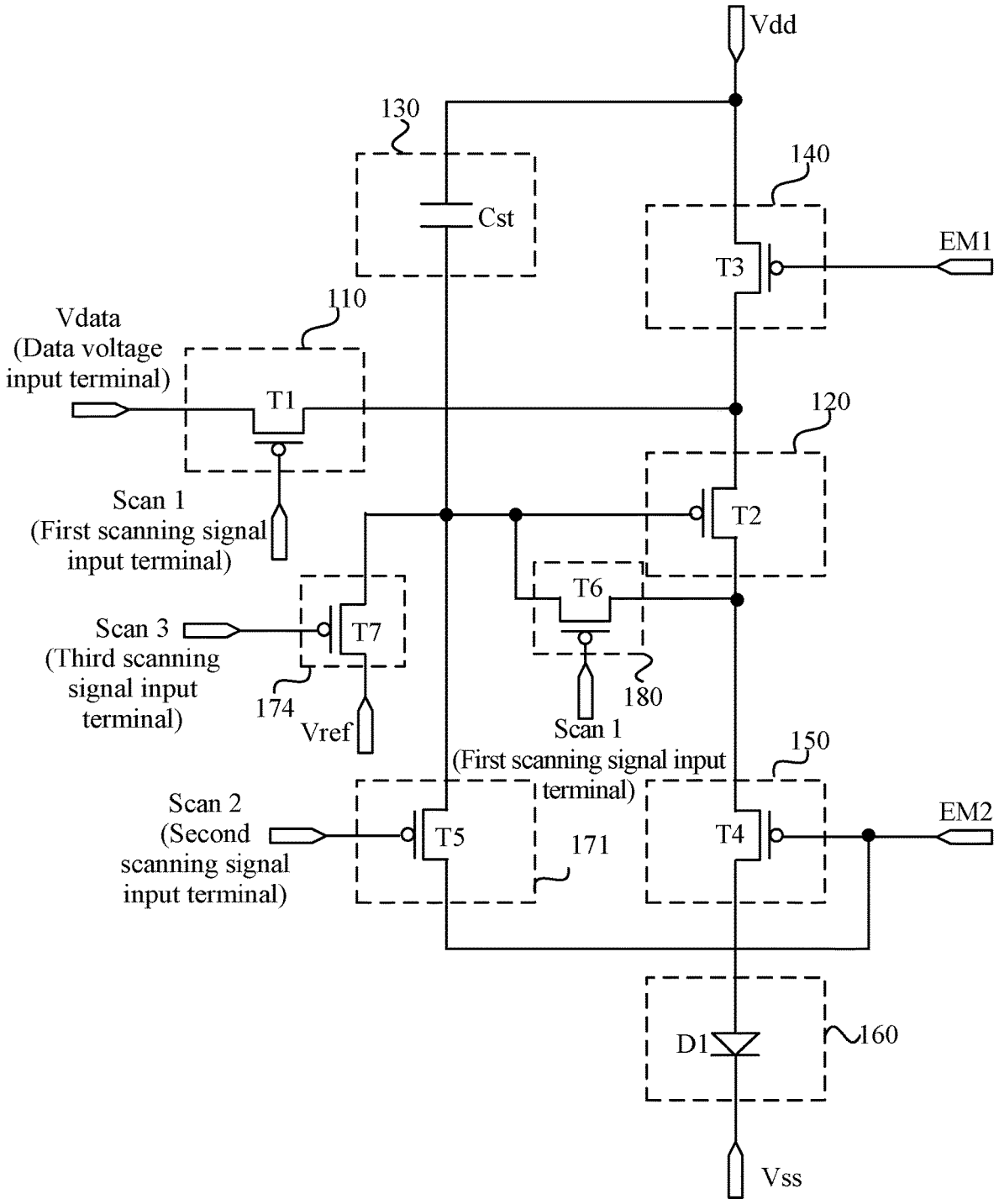
FIG. 14 is a structural diagram of another pixel circuit according to an embodiment of the present disclosure.

FIG. 14 is a structural diagram of another pixel circuit according to an embodiment of the present disclosure. The pixel circuit may correspond to the pixel circuit shown in FIG. 13 whose modules are subdivided into specific components. Referring to FIG. 13, in an embodiment, the data-writing module 110 includes a first transistor T1, the drive module 120 includes a second transistor T2, the first light emission control module 140 includes a third transistor T3, the second light emission control module 150 includes a fourth transistor T4, the first initialization module 171 includes a fifth transistor T5, the compensation module 180 includes a sixth transistor T6, the fourth initialization module 174 includes a seventh transistor T7, the storage module 130 includes a storage capacitor Cst, and the light-emitting module 160 includes an organic light-emitting device D1.

A gate electrode of the first transistor T1 is electrically connected to the first scanning signal input terminal Scan1, a first electrode of the first transistor T1 is electrically connected to the data voltage input terminal Vdata of the pixel circuit, and a second electrode of the first transistor T1 is electrically connected to a first electrode of the second transistor T2.

A gate electrode of the second transistor T2 is electrically connected to a second electrode of the sixth transistor T6, the first electrode of the second transistor T2 is electrically connected to a second electrode of the third transistor T3, and a second electrode of the second transistor T2 is electrically connected to a first electrode of the fourth transistor T4.

A gate electrode of the third transistor T3 is electrically connected to the first light emission control signal input terminal EM1, and a first electrode of the third transistor T3 is electrically connected to the first power voltage input terminal Vdd.

A gate electrode of the fourth transistor T4 is electrically connected to the second light emission control signal input terminal EM2, and a second electrode of the fourth transistor T4 is electrically connected to a first electrode of the organic light-emitting device D1.

A gate electrode of the fifth transistor T5 is electrically connected to the second scanning signal input terminal Scan2 of the pixel circuit, a first electrode of the fifth transistor T5 is electrically connected to the second light emission control signal input terminal EM2, and a second electrode of the fifth transistor T5 is electrically connected to the gate electrode of the second transistor T2.

A gate electrode of the sixth transistor T6 is electrically connected to the first scanning signal input terminal Scan1, and a first electrode of the sixth transistor T6 is electrically connected to the second electrode of the second transistor T2.

A gate electrode of the seventh transistor T7 is electrically connected to the third scanning signal input terminal Scan3 of the pixel circuit, a first electrode of the seventh transistor T7 is electrically connected to the initialization voltage input terminal Vref of the pixel circuit, and a second electrode of the seventh transistor T7 is electrically connected to the gate electrode of the second transistor T2.

Two terminals of the storage capacitor Cst are respectively electrically connected to the gate electrode of the second transistor T2 and the first power voltage input terminal Vdd.

A second electrode of the organic light-emitting device D1 is electrically connected to the second power voltage input terminal Vss.

The working time sequence shown in FIG. 12 is also applicable to the pixel circuit shown in FIG. 14, which is not repeated herein.

Figure 15:
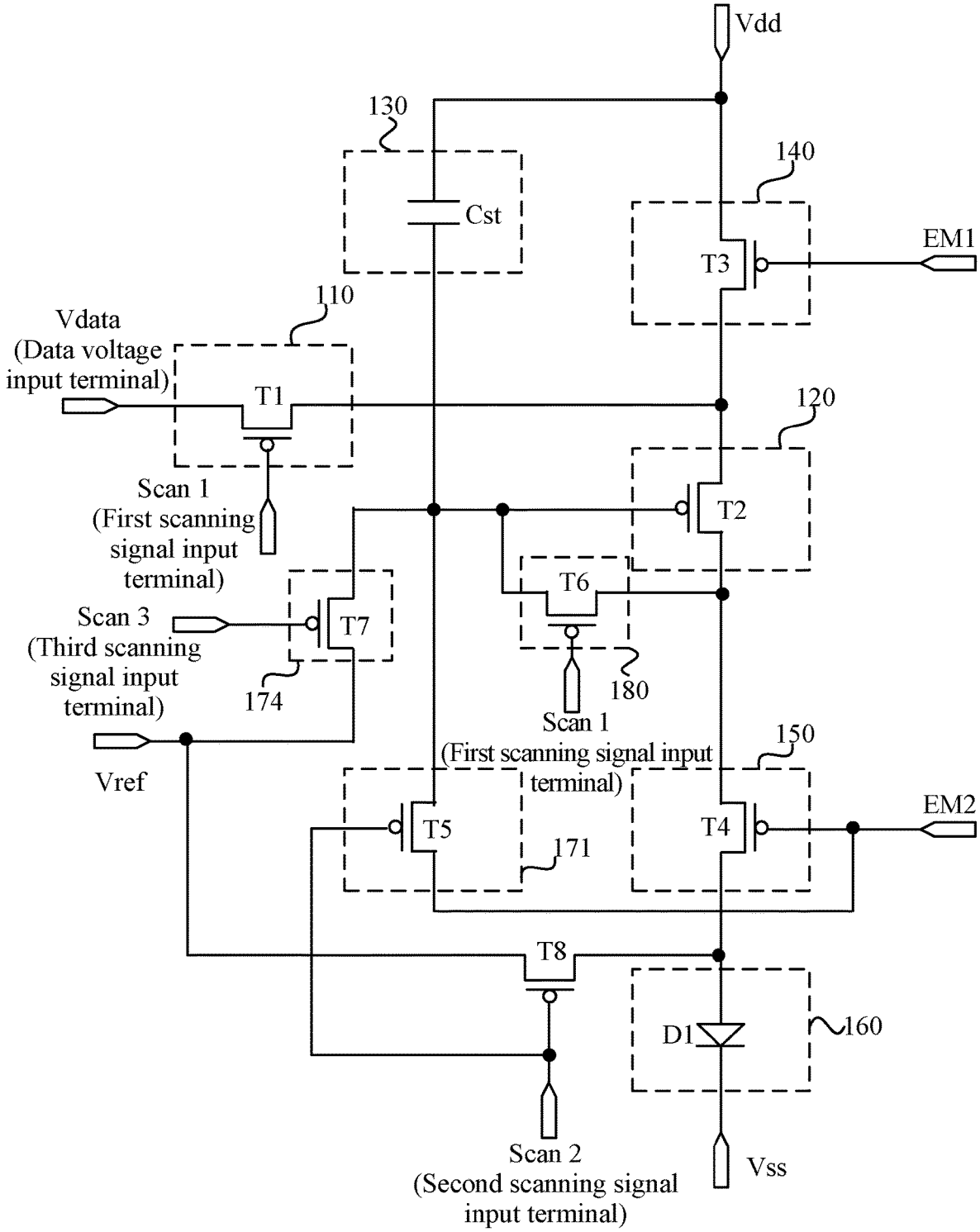
FIG. 15 is a structural diagram of another pixel circuit according to an embodiment of the present disclosure.

FIG. 15 is a structural diagram of another pixel circuit according to an embodiment of the present disclosure. Referring to FIG. 15, on the basis of the pixel circuit shown in FIG. 14, the pixel circuit further includes an eighth transistor T8. A gate electrode of the eighth transistor T8 is electrically connected to the second scanning signal input terminal Scan2, a first electrode of the eighth transistor T8 is electrically connected to an initialization voltage input terminal, and a second electrode of the eighth transistor T8 is electrically connected to the first electrode of the light-emitting device D1.

The working time sequence shown in FIG. 12 is also applicable to the pixel circuit shown in FIG. 15. Referring to FIG. 12 and FIG. 15, the working process of the pixel circuit shown in FIG. 15 may include a first initialization stage t41, a second initialization stage t42, a data-writing stage t43 and a light emission stage t44.

In the first initialization stage t41, a low-level signal is input into the second scanning signal input terminal Scan2, the fifth transistor T5 is turned on. A high-level signal input into the second light emission control signal input terminal EM2 is transmitted to the gate electrode of the second transistor T2 through the fifth transistor T5. The eighth transistor T8 is turned on, and an initialization voltage input into the initialization voltage input terminal Vref is transmitted to the first electrode of the organic light-emitting device D1 through the eighth transistor T8 which is turned on. A low-level signal is input into the first light emission control signal input terminal EM1, and the third transistor T3 is turned on. A high-level signal input into the first power voltage input terminal Vdd is transmitted to the first electrode of the second transistor T2, so that the complete reset of the second transistor T2 is achieved.

In the second initialization stage t42, a low-level signal is input into the third scanning signal input terminal Scan3, and the initialization voltage is transmitted to the gate electrode of the second transistor T2 through the seventh transistor T7 which is turned on.

In the data-writing stage t43, a low-level signal is input into the first scanning signal input terminal Scan1, and the first transistor T1 and the sixth transistor T6 are turned on. A data voltage is transmitted to the gate electrode of the second transistor T2 through the first transistor T1, the second transistor T2 and the sixth transistor T6 which are turned on, so that the writing of the data voltage and the compensation for the threshold voltage of the second transistor T2 are completed.

In the light emission stage t44, a low-level signal is input into the first light emission control signal input terminal EM1 and the second light emission control signal input terminal EM2, the third transistor T3 and the fourth transistor T4 are turned on, and the second transistor T2 drives the organic light-emitting device D1 to emit light.

All the preceding embodiments refer to the working process of the pixel circuit when the first terminal of the first initialization module 171 is electrically connected to the second light emission control signal input terminal EM2. The working process of the pixel circuit when the first terminal of the first initialization module 171 is electrically connected to the initialization voltage input terminal Vref is described below.

Figure 16:
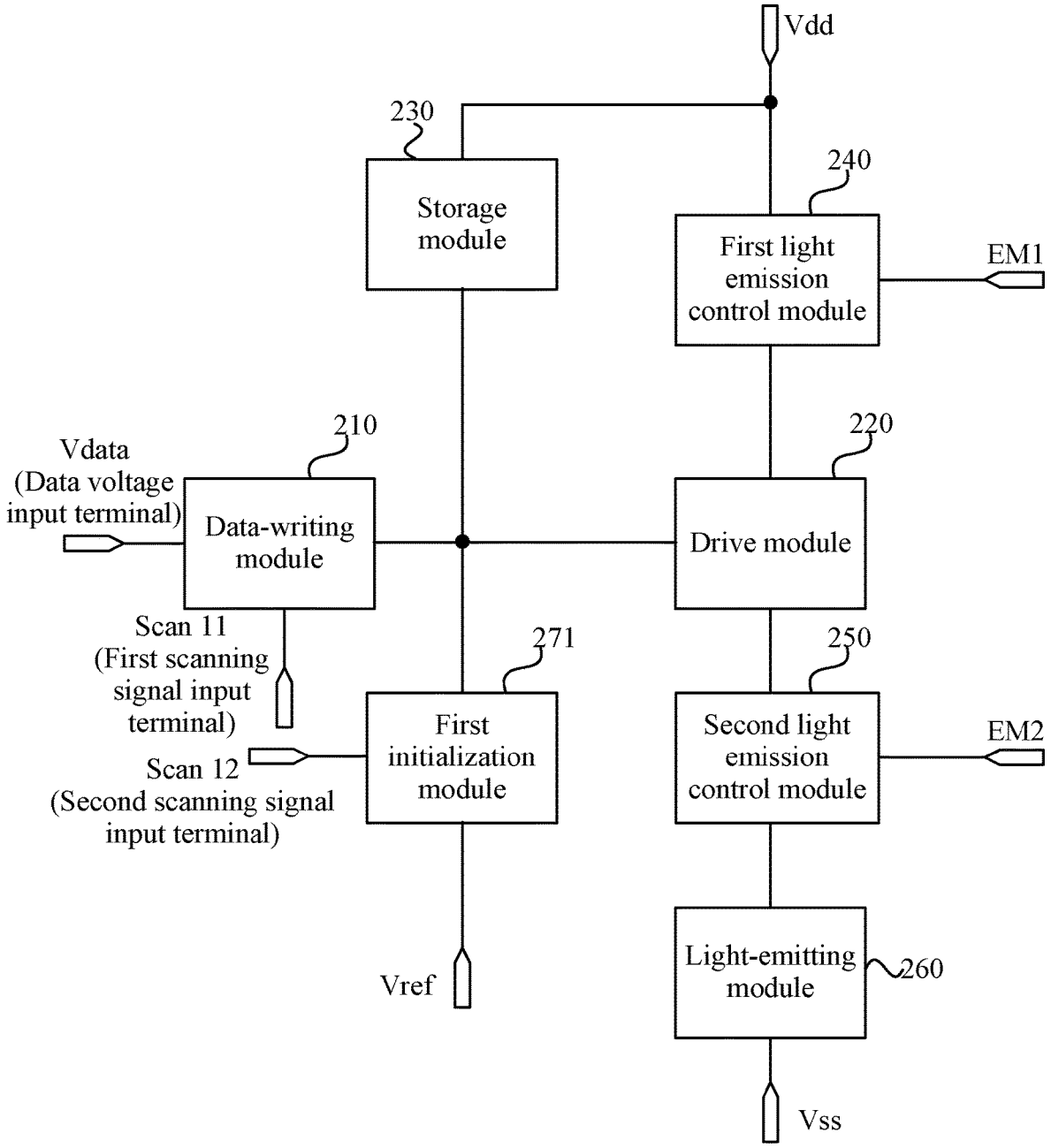
FIG. 16 is a structural diagram of another pixel circuit according to an embodiment of the present disclosure.

FIG. 16 is a structural diagram of another pixel circuit according to an embodiment of the present disclosure. Referring to FIG. 16, the pixel circuit includes: a data-writing module 210, a drive module 220, a storage module 230, a first light emission control module 240, a second light emission control module 250, a light-emitting module 260 and a first initialization module 271.

A control terminal of the data-writing module 210 is electrically connected to a first scanning signal input terminal Scan11, a first terminal of the data-writing module 210 is electrically connected to a data voltage input terminal Vdata of the pixel circuit, and a second terminal of the data-writing module 210 is electrically connected to a control terminal of the drive module 220.

A first terminal of the drive module 220 is electrically connected to a second terminal of the first light emission control module 240, and a second terminal of the drive module 220 is electrically connected to a first terminal of the second light emission control module 250.

A control terminal of the first light emission control module 240 is electrically connected to a first light emission control signal input terminal EM1, and a first terminal of the first light emission control module 240 is electrically connected to a first power voltage input terminal Vdd.

A control terminal of the second light emission control module 250 is electrically connected to a second light emission control signal input terminal EM2, and a second terminal of the second light emission control module 250 is electrically connected to a second power voltage input terminal Vss through the light-emitting module 260.

A control terminal of the first initialization module 271 is electrically connected to a second scanning signal input terminal Scan12 of the pixel circuit, a first terminal of the first initialization module 271 is electrically connected to an initialization voltage input terminal Vref, and a second terminal of the first initialization module 271 is electrically connected to the control terminal of the drive module 220.

Figure 17:
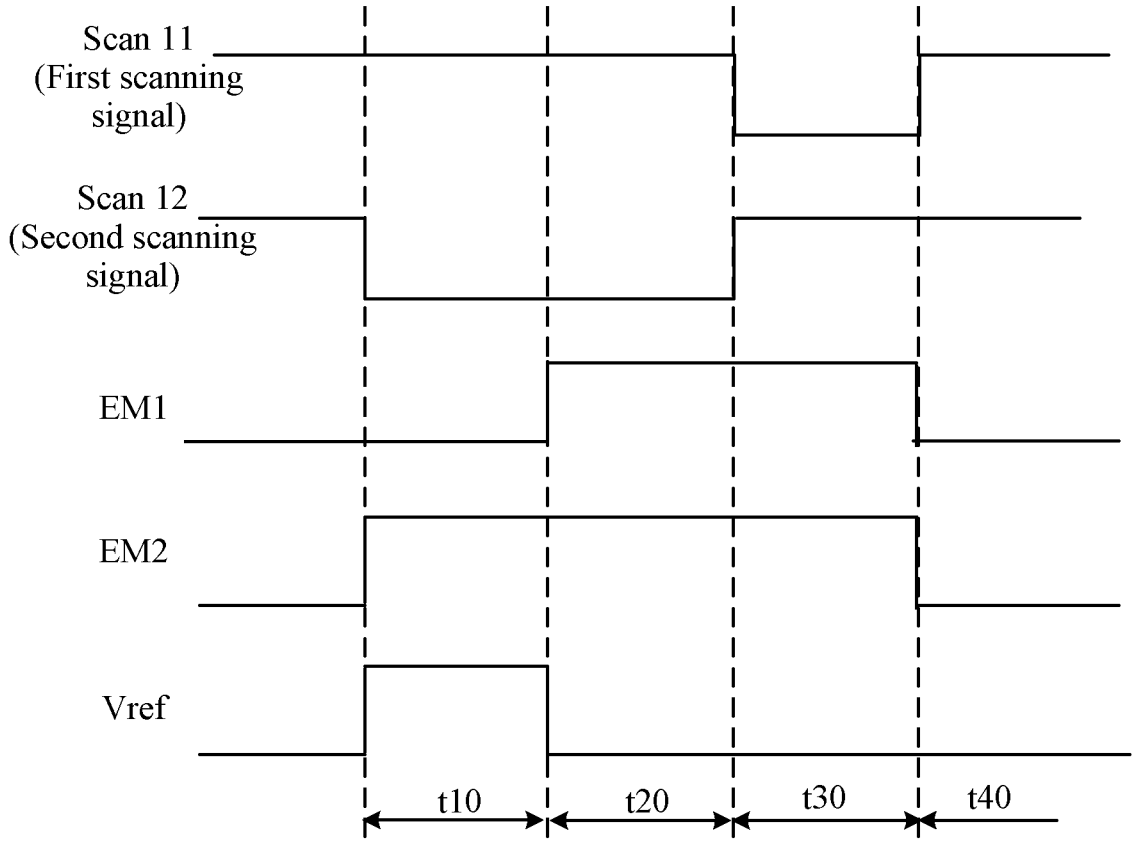
FIG. 17 is another working time sequence diagram applicable to the pixel circuit shown in FIG. 16 according to an embodiment of the present disclosure.

FIG. 17 is a working time sequence diagram of another pixel circuit according to an embodiment of the present disclosure. The working time sequence shown in FIG. 17 may be applicable to the pixel circuit shown in FIG. 16. Referring to FIG. 16 and FIG. 17, the working process of the pixel circuit may include a first initialization stage t10, a second initialization stage t20, a data-writing stage t30, and a light emission stage t40. The signal input into the first power voltage input terminal Vdd being a high-level signal and the signal input into the second power voltage input terminal Vss being a low-level signal are taken as an example for description, and each module in the pixel circuit being turned on by a low-level signal input into the control terminal of the each module is taken as an example for description.

In the first initialization stage t10, a low-level signal is input into the second scanning signal input terminal Scan12, the first initialization module 271 is turned on, and a high-level signal input into the initialization voltage input terminal Vref is transmitted to the control terminal of the drive module 220 through the first initialization module 271 which is turned on; a low-level signal is input into the first light emission control signal input terminal EM1, and the first light emission control module 240 is turned on and transmits a high-level signal input into the first power voltage input terminal Vdd to the first terminal of the drive module 220. That is, in the first initialization stage t10, the potential of the control terminal and the potential of the first terminal of the drive module 220 are fixed, and the complete reset of the drive module 220 is achieved.

In the second initialization stage t20, a low-level signal is input into the second scanning signal input terminal Scan12, the first initialization module 271 is turned on, and a low-level signal input into the initialization voltage input terminal Vref is transmitted to the control terminal of the drive module 220 through the first initialization module 271 which is turned on. Therefore, the potential of the control terminal of the drive module 220 is initialized to a relatively-low-level potential signal, so that it is relatively easy to achieve the writing of a data voltage to the control terminal of the drive module 220 in the subsequent stage.

In the data-writing stage t30, a low-level signal is input into the first scanning signal input terminal Scan11, the data-writing module 210 is turned on, a data voltage input into the data voltage input terminal Vdata is transmitted to the control terminal of the drive module 220 through the data-writing module 210 which is turned on, and the storage module 230 stores the potential between the control terminal of the drive module 220 and the first terminal of the drive module 220.

In the light emission stage t40, a low-level signal is input into the first light emission control signal input terminal EM1 and the second light emission control signal input terminal EM2, the first light emission control module 240 and the second light emission control module 250 are turned on, and the drive module 220 drives the light-emitting module 260 to emit light.

It should be noted that in the above working time sequence, the second initialization stage t20 may also be omitted, that is, the working process of the pixel circuit only includes the first initialization stage t10, the data-writing stage t30 and the light emission stage t40.

Figure 18:
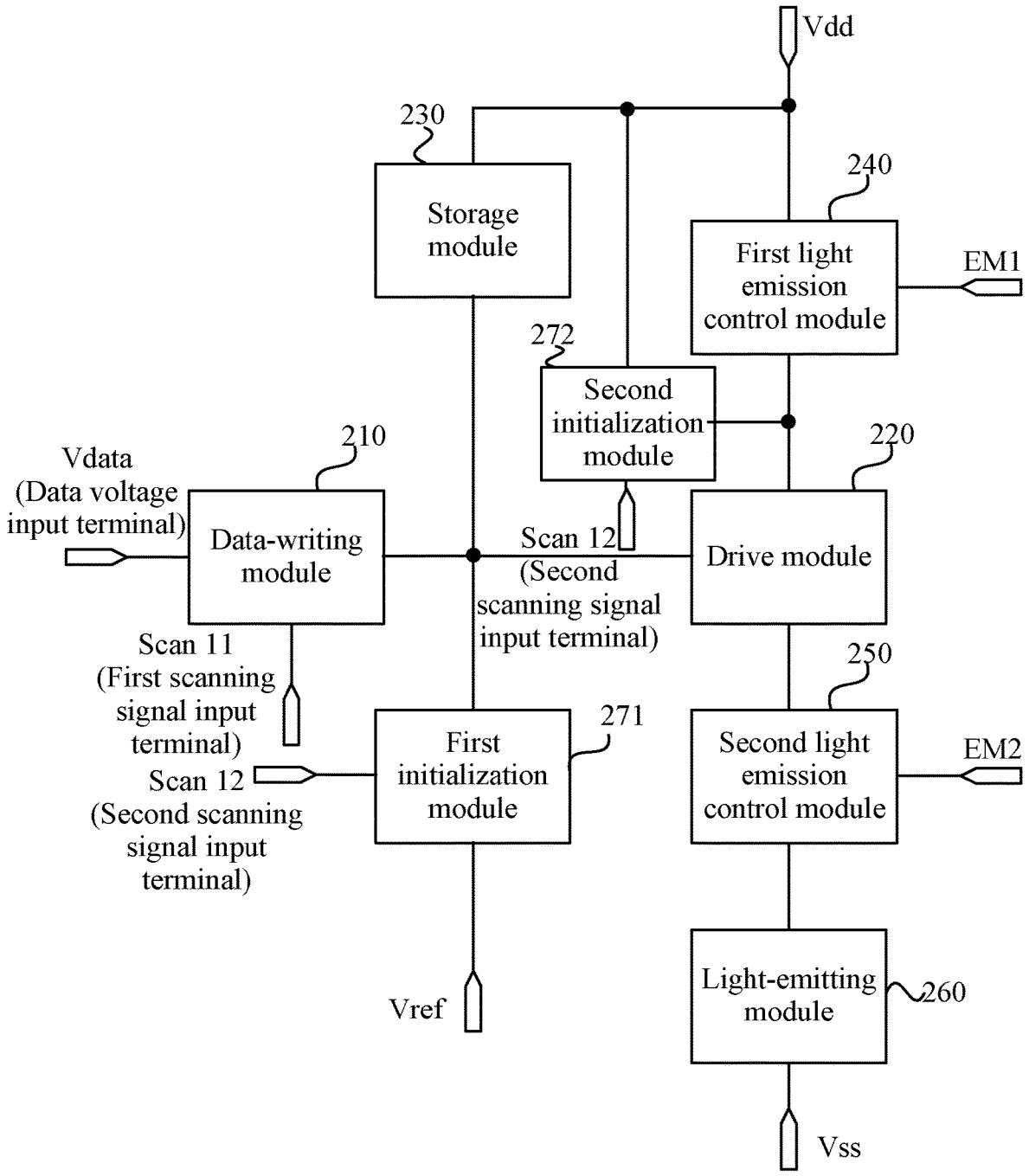
FIG. 18 is a structural diagram of another pixel circuit according to an embodiment of the present disclosure.

FIG. 18 is a structural diagram of another pixel circuit according to an embodiment of the present disclosure. Referring to FIG. 18, in an embodiment, the first terminal of the first initialization module 271 is electrically connected to the initialization voltage input terminal Vref; the pixel circuit further includes: a second initialization module 272, and the second initialization module 272 includes a control terminal, a first terminal and a second terminal. The first terminal of the second initialization module 272 is electrically connected to the first power voltage input terminal Vdd, and the second terminal of the second initialization module 272 is electrically connected to the first terminal of the drive module 220; and the second initialization module 272 is configured to initialize the first terminal of the drive module 220 under a control of an input signal of the control terminal of the second initialization module 272. In an embodiment, the control terminal of the second initialization module 272 may be connected to the second scanning signal input terminal Scan12.

The signal input into the first power voltage input terminal Vdd being a high-level signal and the signal input into the second power voltage input terminal Vss being a low-level signal are taken as an example for description in embodiments described below, and each module in the pixel circuit being turned on by a low-level signal input into the control terminal of the each module is taken as an example for description.

Figure 19:
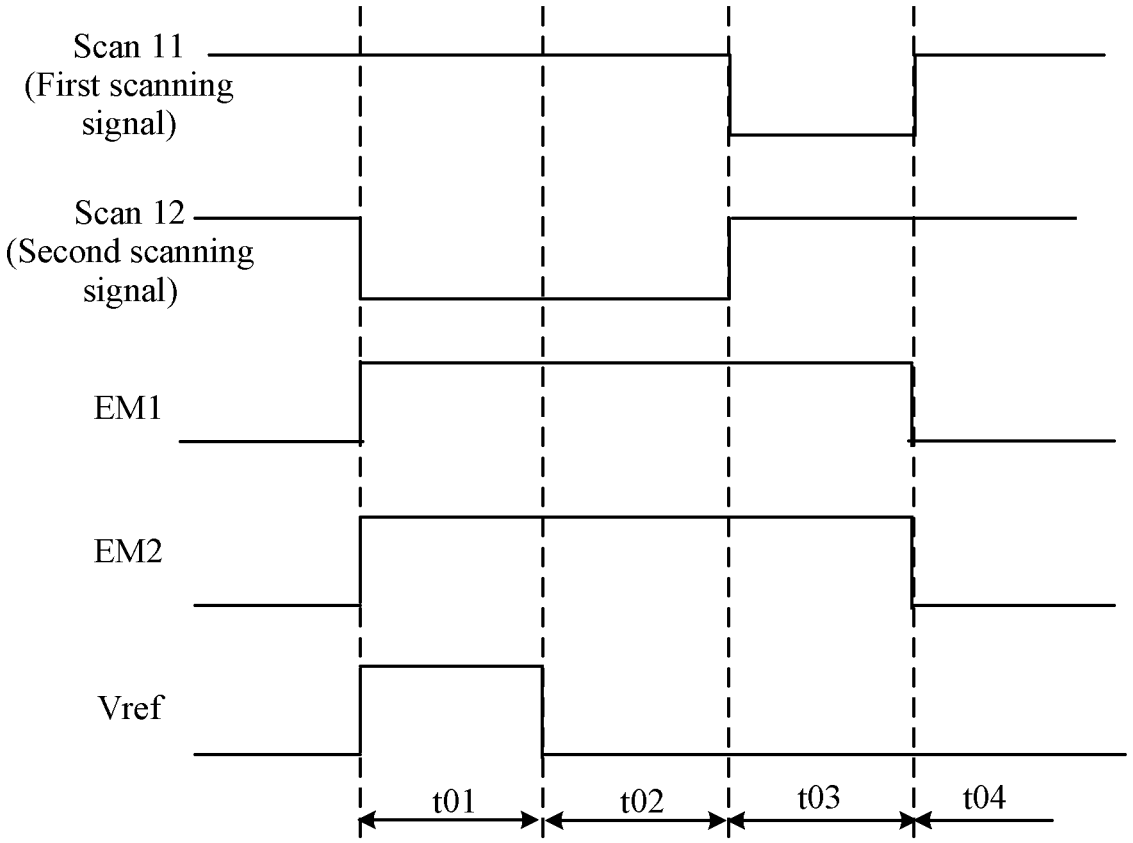
FIG. 19 is another working time sequence diagram applicable to the pixel circuit shown in FIG. 18 according to an embodiment of the present disclosure.

FIG. 19 is a working time sequence diagram of another pixel circuit according to an embodiment of the present disclosure. The working time sequence shown in FIG. 19 may be applicable to the pixel circuit shown in FIG. 18. Referring to FIG. 18 and FIG. 19, in a first initialization stage t01, a low-level signal is input into the second scanning signal input terminal Scan12, the first initialization module 271 is turned on, and a high-level signal input into the initialization voltage input terminal Vref is transmitted to the control terminal of the drive module 220 through the first initialization module 271 which is turned on; the second initialization module 272 is turned on and transmits a high-level signal input into the first power voltage input terminal Vdd to the first terminal of the drive module 220. That is, in the first initialization stage, the potential of the control terminal and the potential of the first terminal of the drive module 220 are fixed, and the complete reset of the drive module 220 is achieved.

In a second initialization stage t02, the second initialization module 272 is turned on; in a data-writing stage t03 and a light emission stage t04, the second initialization module 272 is turned off. The turned-on states or turned-off states of modules other than the second initialization module 272 in the second initialization stage t02, the data-writing stage t03 and the light emission stage t04 are respectively the same as the turned-on states or turned-off states of modules other than the second initialization module 272 in the processes of the second initialization stage t20, the data-writing stage t30 and the light emission stage t40 in the preceding embodiment, which is not repeated herein.

From the time sequence shown in FIG. 19, it can be seen that for the pixel circuit shown in FIG. 18, the signal input into the first light emission control signal input terminal EM1 can be the same as the signal input into the second light emission control signal input terminal EM2, so that the two input terminals can be combined into one terminal, and thus the number of input terminals of the pixel circuit is reduced. Therefore, the first light emission control signal input terminal EM1 and the second light emission control signal input terminal EM2 can be connected to the same light emission control line, which is beneficial to reducing the number of signal lines in the display panel.

Figure 20:
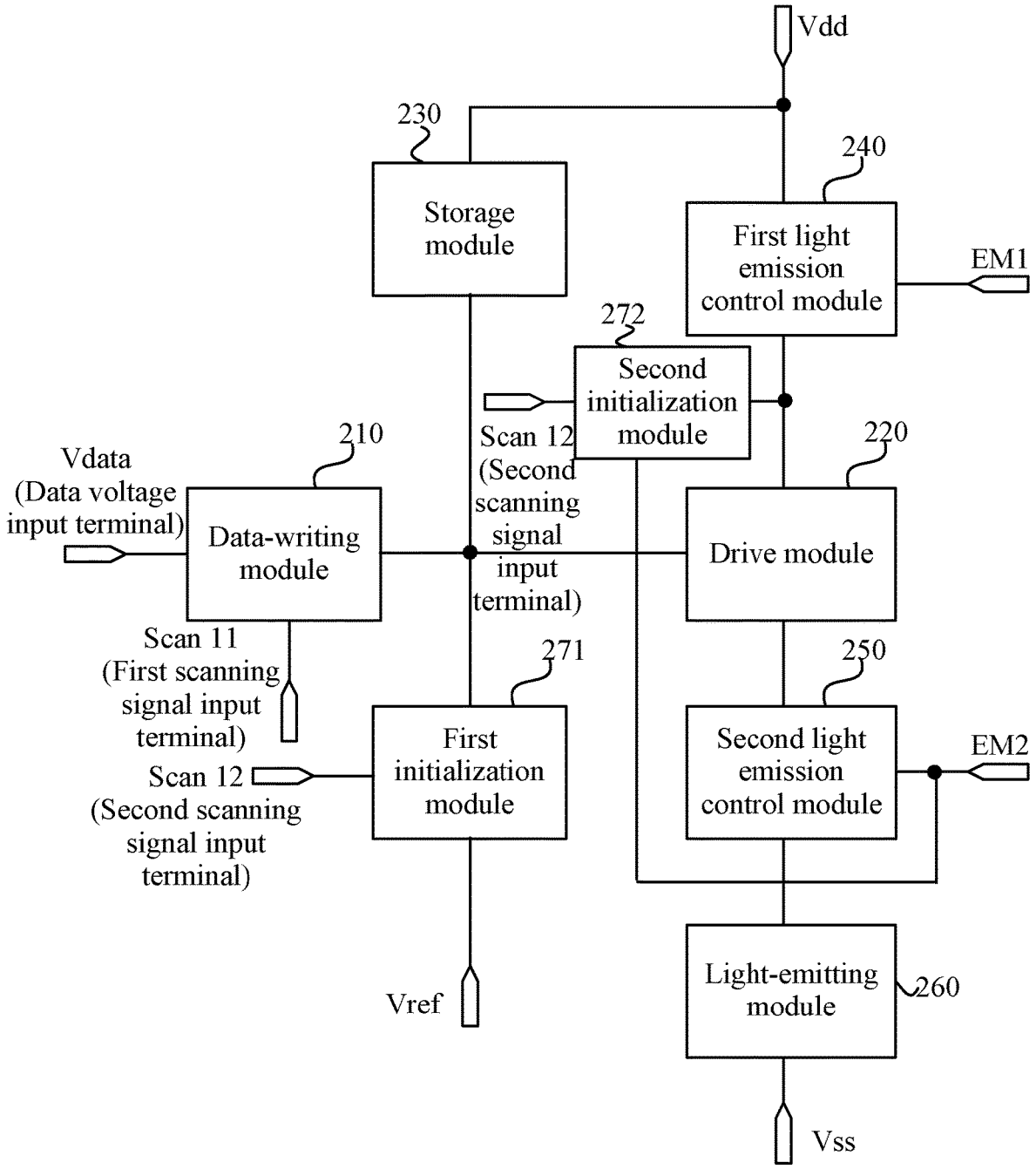
FIG. 20 is a structural diagram of another pixel circuit according to an embodiment of the present disclosure.

FIG. 20 is a structural diagram of another pixel circuit according to an embodiment of the present disclosure. Referring to FIG. 20, in an embodiment, the first terminal of the first initialization module 271 is electrically connected to the initialization voltage input terminal Vref. The pixel circuit further includes a second initialization module 272, the second initialization module 272 includes a control terminal, a first terminal and a second terminal, the first terminal of the second initialization module 272 is electrically connected to the second light emission control signal input terminal EM2, and the second terminal of the second initialization module 272 is electrically connected to the first terminal of the drive module 220; and the second initialization module 272 is configured to initialize the first terminal of the drive module 220 under a control of an input signal of the control terminal of the second initialization module 172.

The working time sequence shown in FIG. 19 is also applicable to the pixel circuit shown in FIG. 20. Referring to FIG. 19 and FIG. 20, in the first initialization stage t01, a low-level signal is input into the second scanning signal input terminal Scan12, the first initialization module 271 is turned on, and a high-level signal input into the initialization voltage input terminal Vref is transmitted to the control terminal of the drive module 220 through the first initialization module 271 which is turned on; the second initialization module 272 is turned on and transmits a high-level signal input into the second scanning signal input terminal EM2 to the first terminal of the drive module 220. That is, in the first initialization stage t01, the potential of the control terminal and the potential of the first terminal of the drive module 220 are fixed, and the complete reset of the drive module 220 is achieved.

In the second initialization stage t02, the second initialization module 272 is turned on; in the data-writing stage t03 and the light emission stage t04, the second initialization module 272 is turned off. The turned-on states or turned-off states of modules other than the second initialization module 272 in the second initialization stage t02, the data-writing stage t03 and the light emission stage t04 are respectively the same as the turned-on states or turned-off states of modules other than the second initialization module 272 in the processes of the second initialization stage t20, the data-writing stage t30 and the light emission stage t40 in the preceding embodiment, which is not repeated herein.

From the time sequence shown in FIG. 19, it can be seen that for the pixel circuit shown in FIG. 20, the signal input into the first light emission control signal input terminal EM1 can be the same as the signal input into the second light emission control signal input terminal EM2, so that the two input terminals can be combined into one terminal, and thus the number of input terminals of the pixel circuit is reduced. Therefore, the first light emission control signal input terminal EM1 and the second light emission control signal input terminal EM2 can be connected to the same light emission control line, which is beneficial to reducing the number of signal lines in the display panel.

It should be noted that in the working time sequence shown in FIG. 19, the second initialization stage t02 may also be omitted, that is, the working process of the pixel circuit only includes the first initialization stage t01, the data-writing stage t03 and the light emission stage t04.

Figure 21:
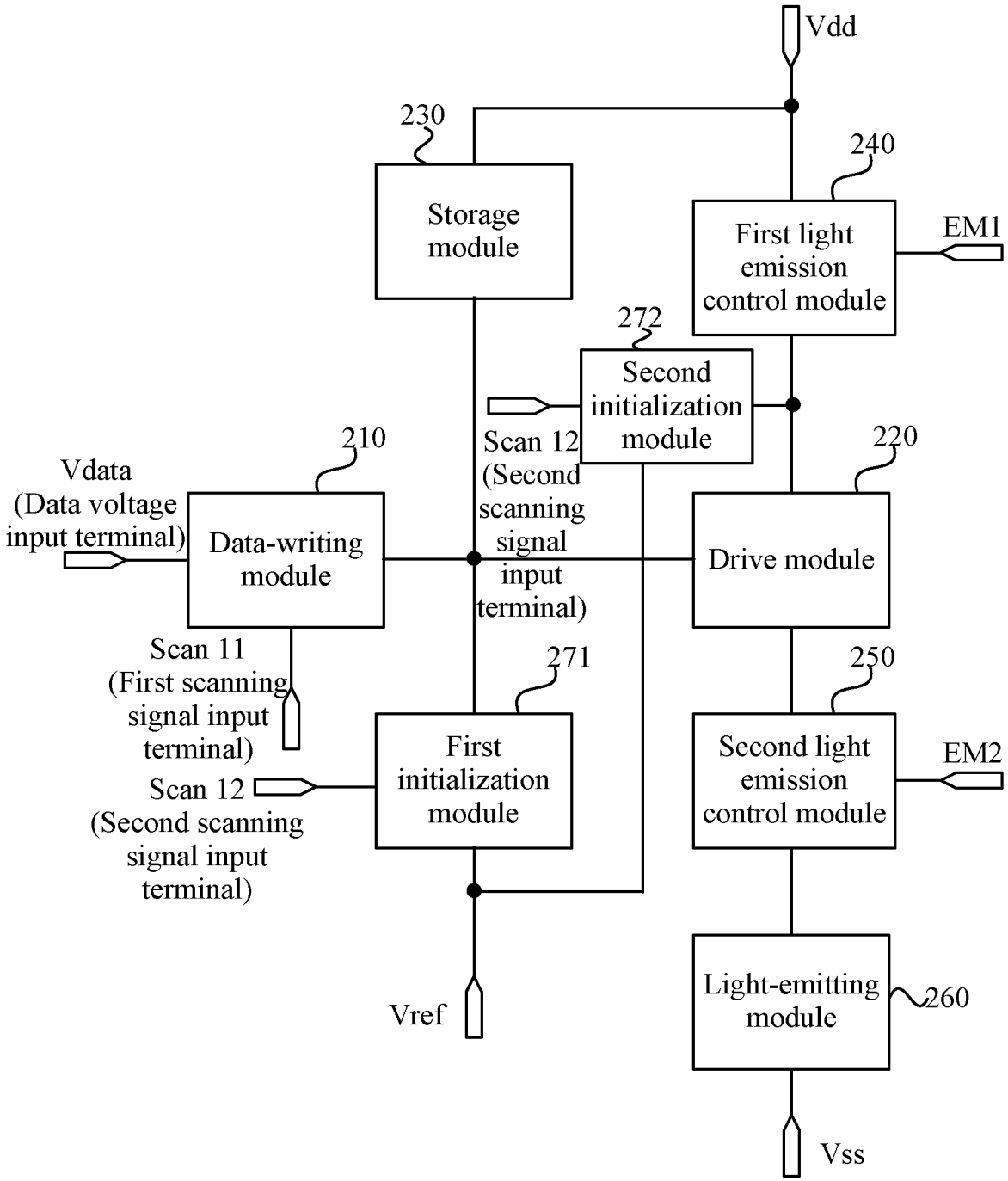
FIG. 21 is a structural diagram of another pixel circuit according to an embodiment of the present disclosure.

FIG. 21 is a structural diagram of another pixel circuit according to an embodiment of the present disclosure. Referring to FIG. 21, in an embodiment, the first terminal of the first initialization module 271 is electrically connected to the initialization voltage input terminal Vref; the pixel circuit further includes a second initialization module 272, and the second initialization module 272 includes a control terminal, a first terminal and a second terminal. The first terminal of the second initialization module 272 is electrically connected to the initialization voltage input terminal Vref, and the second terminal of the second initialization module 272 is electrically connected to the first terminal of the drive module 220. The second initialization module 272 is configured to initialize the first terminal of the drive module 220 under a control of an input signal of the control terminal of the second initialization module 272.

Figure 22:
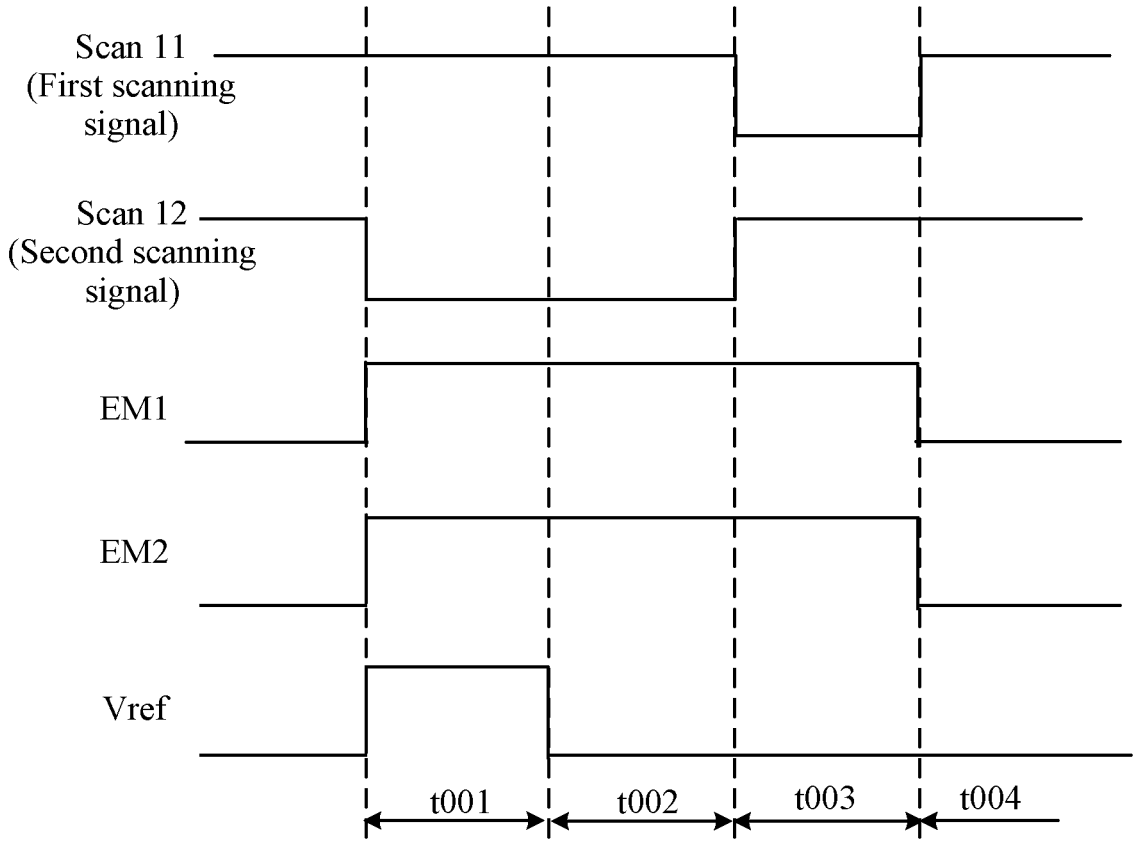
FIG. 22 is another working time sequence diagram applicable to the pixel circuit shown in FIG. 21 according to an embodiment of the disclosure.

FIG. 22 is a working time sequence diagram of another pixel circuit according to an embodiment of the present disclosure. The working time sequence can be used to drive the pixel circuit shown in FIG. 21. Referring to FIG. 21 and FIG. 22, the working process of the pixel circuit may be divided into a first initialization stage t001, a second initialization stage t002, a data-writing stage t003 and a light emission stage t004.

In the first initialization stage t001, a low-level signal is input into the second scanning signal input terminal Scan12, the first initialization module 271 is turned on, and a high-level signal input into the initialization voltage input terminal Vref is transmitted to the control terminal of the drive module 220 through the first initialization module 271 which is turned on; the second initialization module 272 is turned on, and the high-level signal input into the initialization voltage input terminal Vref is transmitted to the first terminal of the drive module through the second initialization module 272 which is turned on. That is, in the first initialization stage, the potential of the control terminal and the potential of the first terminal of the drive module 220 are fixed, and the complete reset of the drive module 220 is achieved.

In the second initialization stage t002, the second initialization module 272 is turned on; in the data-writing stage t003 and the light emission stage t004, the second initialization module 272 is turned off. The turned-on states or turned-off states of modules other than the second initialization module 272 in the second initialization stage t002, the data-writing stage t003 and the light emission stage t004 are respectively the same as the turned-on states or turned-off states of modules other than the second initialization module 272 in the processes of the second initialization stage t20, the data-writing stage t30 and the light emission stage t40 in the preceding embodiment, which is not repeated herein.

From the time sequence shown in FIG. 22, it can be seen that for the pixel circuit shown in FIG. 21, the signal input into the first light emission control signal input terminal EM1 can be the same as the signal input into the second light emission control signal input terminal EM2, so that the two input terminals can be combined into one terminal, and thus the number of input terminals of the pixel circuit is reduced. Therefore, the first light emission control signal input terminal EM1 and the second light emission control signal input terminal EM2 can be connected to the same light emission control line, which is beneficial to reducing the number of signal lines in the display panel.

It should be noted that in the working time sequence shown in FIG. 22, the second initialization stage t002 may also be omitted, that is, the working process of the pixel circuit only includes the first initialization stage t001, the data-writing stage t003 and the light emission stage t004.

Figure 23:
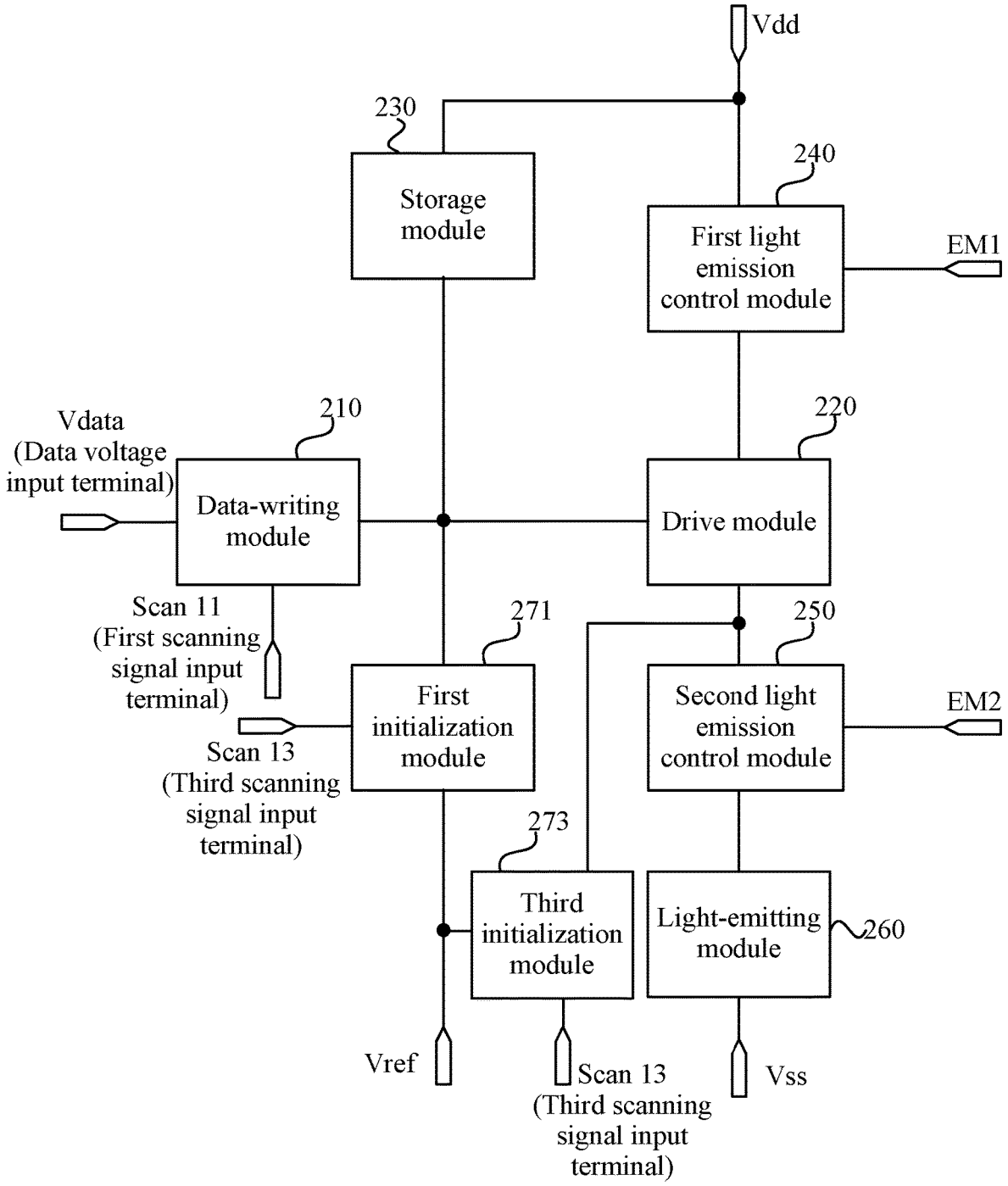
FIG. 23 is a structural diagram of another pixel circuit according to an embodiment of the present disclosure.

FIG. 23 is a structural diagram of another pixel circuit according to an embodiment of the present disclosure. Referring to FIG. 23, in an embodiment, the first terminal of the first initialization module 271 is electrically connected to the initialization voltage input terminal Vref; the pixel circuit further includes a third initialization module 273 and a third scanning signal input terminal Scan13. A control terminal of the third initialization module 273 is electrically connected to the third scanning signal input terminal Scan13, a first terminal of the third initialization module 273 is electrically connected to the initialization voltage input terminal Vref of the pixel circuit, and a second terminal of the third initialization module 273 is electrically connected to the first terminal of the second light emission control module 250.

Figure 24:
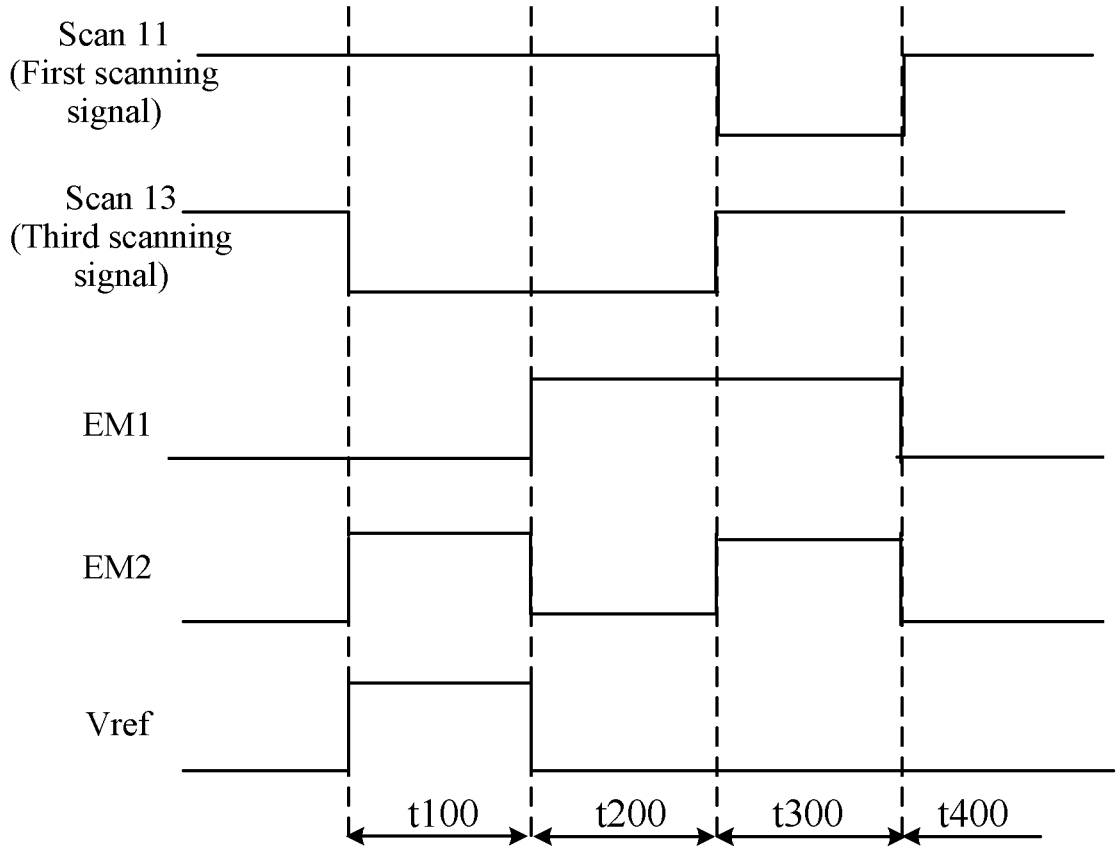
FIG. 24 is another working time sequence diagram applicable to the pixel circuit shown in FIG. 23 according to an embodiment of the present disclosure.

FIG. 24 is a working time sequence diagram of another pixel circuit according to an embodiment of the present disclosure. The working time sequence can be used to drive the pixel circuit shown in FIG. 23. Referring to FIG. 23 and FIG. 24, the working process of the pixel circuit includes a first initialization stage t100, a second initialization stage t200, a data-writing stage t300 and a light emission stage t400.

In the first initialization stage t100, a low-level signal is input into the third scanning signal input terminal Scan13, the first initialization module 271 is turned on, and a high-level signal input into the initialization voltage input terminal Vref is transmitted to the control terminal of the drive module 220 through the first initialization module 271 which is turned on; a low-level signal is input into the first light emission control signal input terminal EM1, and the first light emission control module 240 is turned on and transmits a high-level signal input into the first power voltage input terminal to the first terminal of the drive module 220. That is, in the first initialization stage, the potential of the control terminal and the potential of the first terminal of the drive module 220 are fixed, and the complete reset of the drive module 220 is achieved.

In the second initialization stage t200, a low-level signal is input into the third scanning signal input terminal Scan13, and the third initialization module 273 is turned on; a low-level signal is input into the second light emission control signal input terminal EM2, the second light emission control module is turned on, and a low-level signal input into the initialization voltage input terminal Vref is transmitted to a first terminal of the light-emitting module 260 through the third initialization module 273 and the second light emission control module 250 which are turned on, so that the reset of the first terminal of the light-emitting module 260 is achieved. Moreover, in the second initialization stage t200, the first initialization module is turned on, the low-level signal input into the initialization voltage input terminal Vref is transmitted to the control terminal of the drive module 220, thus the potential of the control terminal of the drive module 220 is initialized to a relatively-low-level potential signal, so that it is relatively easy to achieve the writing of a data voltage to the control terminal of the drive module 220 in the subsequent stage.

In the pixel circuit shown in FIG. 23, the third initialization module 273 is turned off in the data-writing stage t300 and the light emission stage t400. In the pixel circuit shown in FIG. 23, the state of the data-writing module 210, the state of the drive module 220, the state of the storage module 230, the state of the first light emission control module 240, the state of the second light emission control module 250, the state of the light-emitting module 260 and the state of the first initialization module 271 in the data-writing stage t300 and the light emission stage t400 are the same as the state of the data-writing module 210, the state of the drive module 220, the state of the storage module 230, the state of the first light emission control module 240, the state of the second light emission control module 250, the state of the light-emitting module 260 and the state of the first initialization module 271 in the processes of the data-writing stage t30 and the light emission stage t40 in the preceding embodiment, which is not repeated herein.

Figure 25:
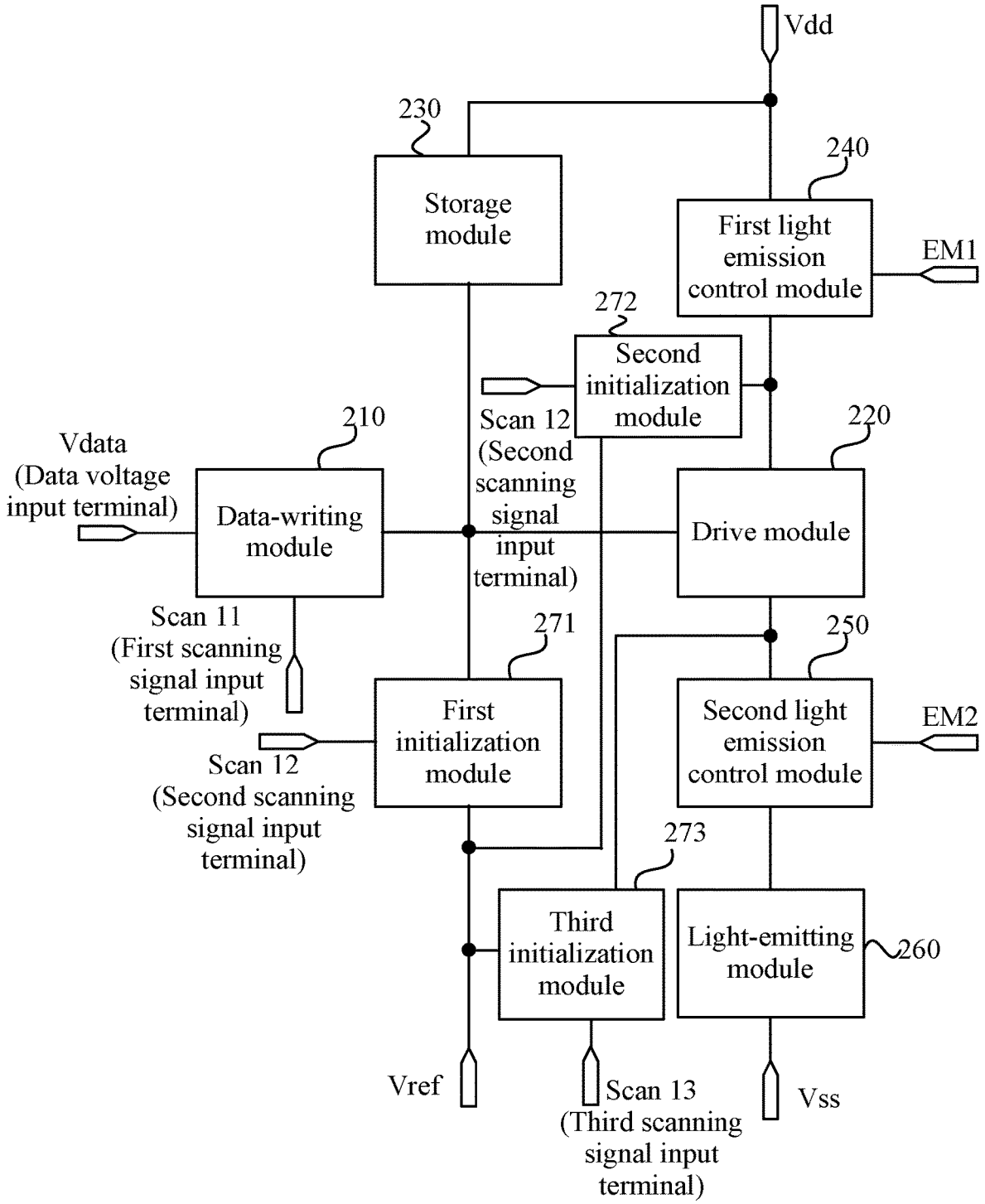
FIG. 25 is a structural diagram of another pixel circuit according to an embodiment of the present disclosure.

FIG. 25 is a structural diagram of another pixel circuit according to an embodiment of the present disclosure. Referring to FIG. 25, the first terminal of the first initialization module 271 is electrically connected to the initialization voltage input terminal Vref, and the control terminal of the first initialization module 271 is electrically connected to the second scanning signal input terminal Scan12. The pixel circuit includes a second initialization module 272, a third initialization module 273 and a third scanning signal input terminal Scan13. A control terminal of the third initialization module 273 is electrically connected to the third scanning signal input terminal Scan13. A first terminal of the third initialization module 273 is electrically connected to the initialization voltage input terminal Vref of the pixel circuit. A second terminal of the third initialization module 273 is electrically connected to the first terminal of the second light emission control module 250. Referring to FIG. 25, the control terminal of the data-writing module 210 is electrically connected to the first scanning signal input terminal Scan11. The control terminal of the first initialization module 271 and the control terminal of the second initialization module 272 are both electrically connected to the second scanning signal input terminal Scan12. The control terminal of the third initialization module 273 is electrically connected to the third scanning signal input terminal Scan13.

Figure 26:
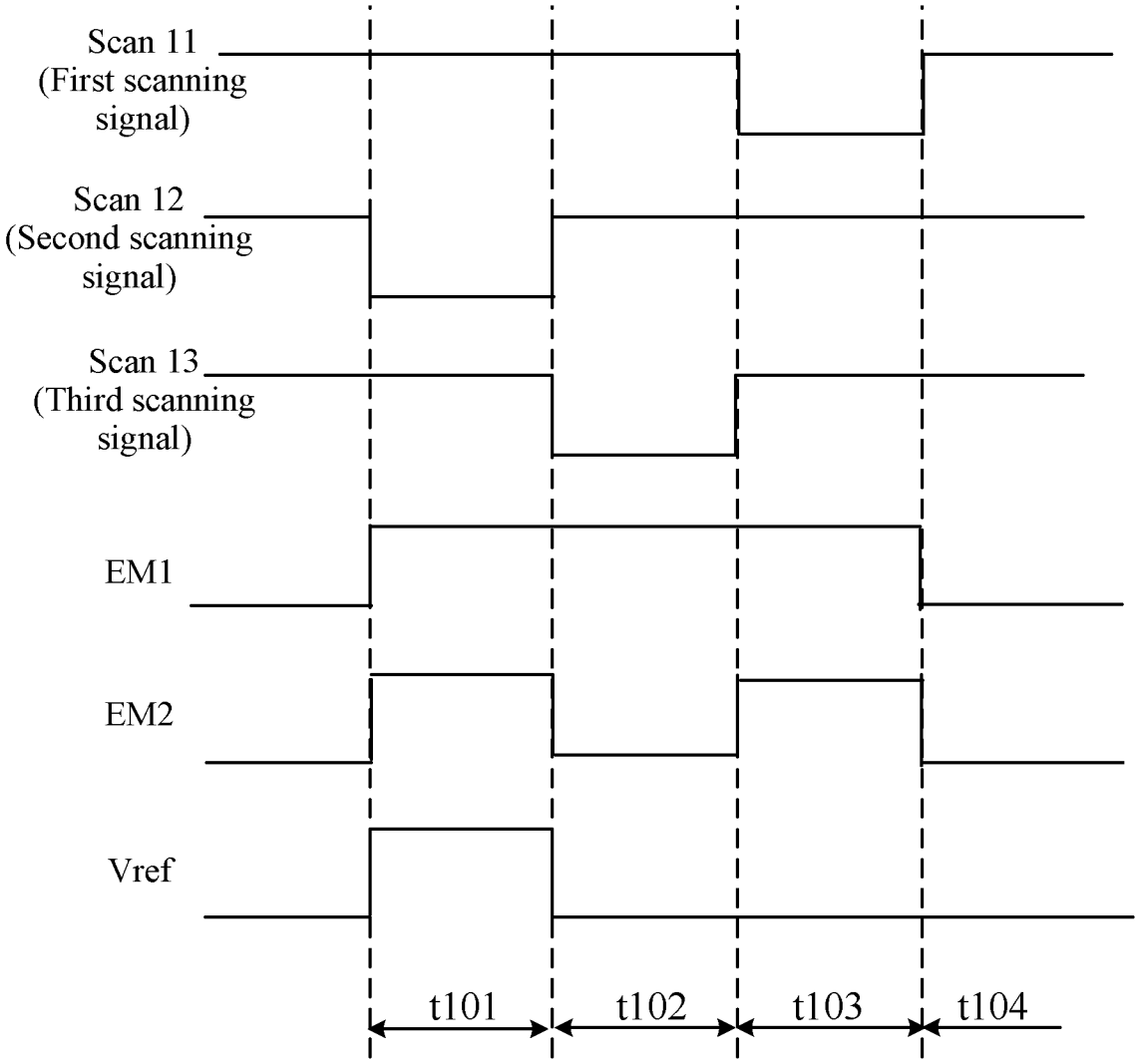
FIG. 26 is another working time sequence diagram applicable to the pixel circuit shown in FIG. 25 according to an embodiment of the present disclosure.

FIG. 26 is a working time sequence diagram of another pixel circuit according to an embodiment of the present disclosure. The working timing can be used to drive the pixel circuit shown in FIG. 25. Referring to FIG. 25 and FIG. 26, the working process of the pixel circuit includes a first initialization stage t101, a second initialization stage t102, a data-writing stage t103 and a light emission stage t104.

In the first initialization stage t101, a low-level signal is input into the second scanning signal input terminal Scan12, the first initialization module 271 is turned on, and a high-level signal input into the initialization voltage input terminal Vref is transmitted to the control terminal of the drive module 220 through the first initialization module 271 which is turned on; the second initialization module 272 is turned on and transmits the high-level signal input into the initialization voltage input terminal Vref to the first terminal of the drive module 220. That is, in the first initialization stage, the potential of the control terminal and the potential of the first terminal of the drive module 220 are fixed, and the complete reset of the drive module 220 is achieved.

In the second initialization stage t102, a low-level signal is input into the third scanning signal input terminal Scan13, and the third initialization module 273 is turned on; a low-level signal is input into the second light emission control signal input terminal EM2, the second light emission control module is turned on, and a low-level signal input into the initialization voltage input terminal Vref is transmitted to the first terminal of the light-emitting module 260 through the third initialization module 273 and the second light emission control module 250 which are turned on, so that the reset of the first terminal of the light-emitting module 260 is achieved.

In the pixel circuit shown in FIG. 25, the second initialization module 272 and the third initialization module 273 are turned off in the data-writing stage t103 and the light emission stage t104. In the pixel circuit shown in FIG. 25, the state of the data-writing module 210, the state of the drive module 220, the state of the storage module 230, the state of the first light emission control module 240, the state of the second light emission control module 250, the state of the light-emitting module 260 and the state of the first initialization module 271 in the data-writing stage t103 and the light emission stage t104 are the same as the state of the data-writing module 210, the state of the drive module 220, the state of the storage module 230, the state of the first light emission control module 240, the state of the second light emission control module 250, the state of the light-emitting module 260 and the state of the first initialization module 271 in the processes of the data-writing stage t30 and the light emission stage t40 in the preceding embodiment, which is not repeated herein.

Figure 27:
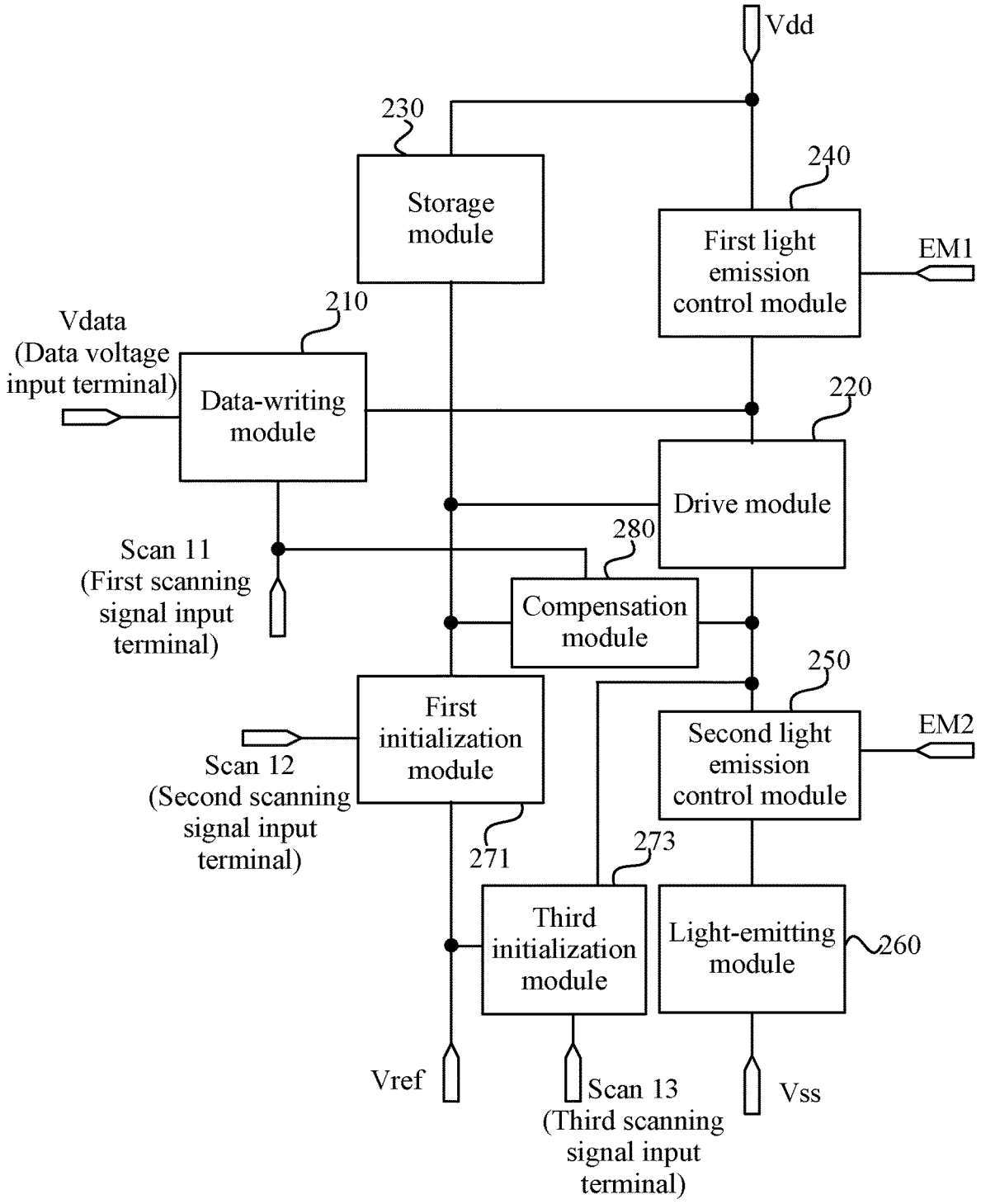
FIG. 27 is a structural diagram of another pixel circuit according to an embodiment of the present disclosure.

FIG. 27 is a structural diagram of another pixel circuit according to an embodiment of the present disclosure. Referring to FIG. 27, in an embodiment, the control terminal of the data-writing module 210 is electrically connected to the first scanning signal input terminal Scan11, the first terminal of the data-writing module 210 is electrically connected to the data voltage input terminal Vdata, and the second terminal of the data-writing module 210 is electrically connected to the first terminal of the drive module 220; and a first terminal of the storage module 230 is electrically connected to the control terminal of the drive module 220, and a second terminal of the storage module 230 is electrically connected to the first power voltage input terminal Vdd.

The pixel circuit further includes a compensation module 280. A control terminal of the compensation module 280 is electrically connected to the first scanning signal input terminal Scan11 of the pixel circuit. A first terminal of the compensation module 280 is electrically connected to the second terminal of the drive module 220. A second terminal of the compensation module 280 is electrically connected to the control terminal of the drive module 220.

Figure 28:
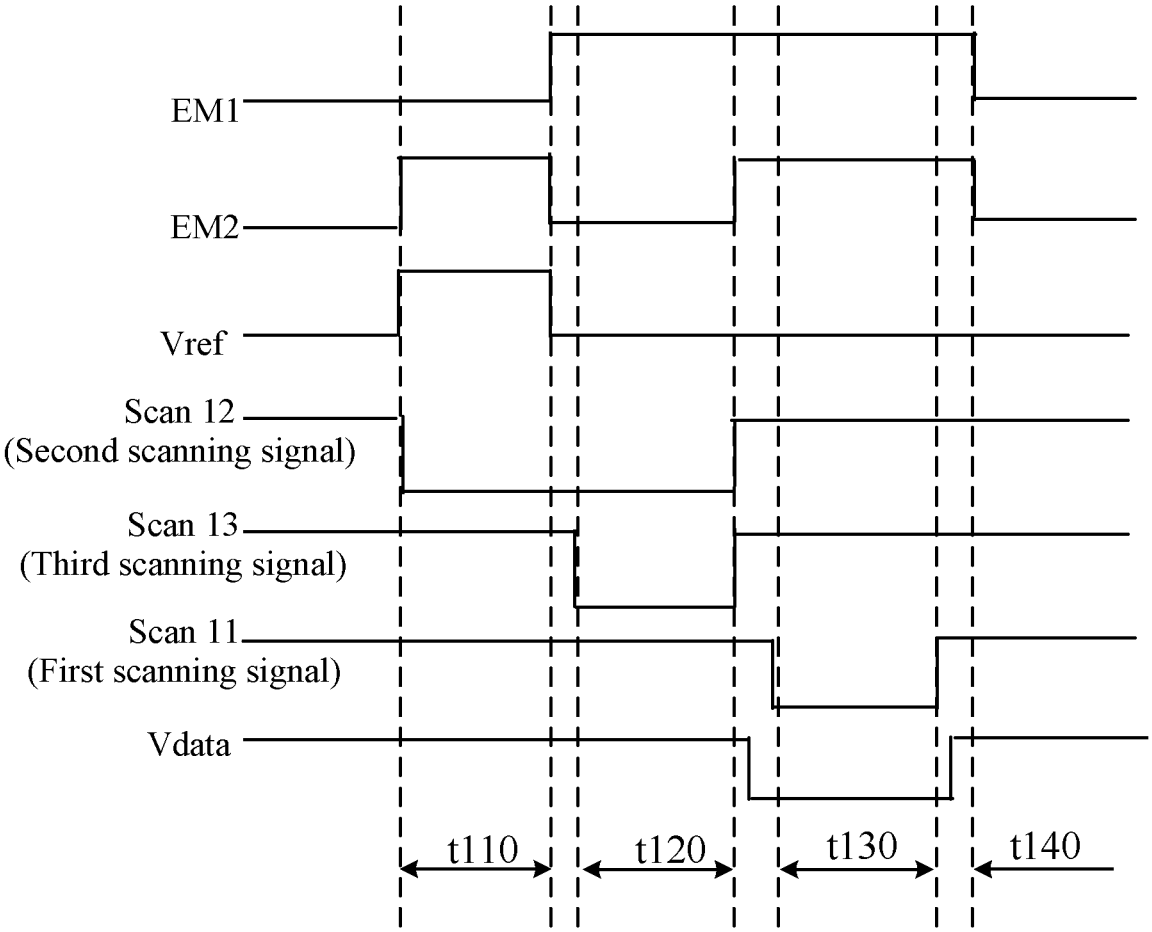
FIG. 28 is another working time sequence diagram applicable to the pixel circuit shown in FIG. 27 according to an embodiment of the present disclosure.

FIG. 28 is a working time sequence diagram of another pixel circuit according to an embodiment of the present disclosure. The working time sequence shown in FIG. 28 can be used to drive the pixel circuit shown in FIG. 27. Referring to FIG. 27 and FIG. 28, the working process of the pixel circuit shown in FIG. 27 may include a first initialization stage t110, a second initialization stage t120, a data-writing stage t130 and a light emission stage t140.

In the first initialization stage t110, a low-level signal is input into the second scanning signal input terminal Scan12, the first initialization module 271 is turned on, and a high-level signal input into the initialization voltage input terminal Vref is transmitted to the control terminal of the drive module 220 through the first initialization module 271 which is turned on. A low-level signal is input into the first light emission control signal input terminal EM1, and the first light emission control module 240 is turned on and transmits a high-level signal input into the first power voltage input terminal Vdd to the first terminal of the drive module 220. That is, in the first initialization stage, the potential of the control terminal and the potential of the first terminal of the drive module 220 are fixed, and the complete reset of the drive module 220 is achieved.

In the second initialization stage t120, a low-level signal is input into the second scanning signal input terminal Scan12 and the third scanning signal input terminal Scan13, the first initialization module 271 and the third initialization module 273 are turned on, and an initialization voltage input into the initialization voltage input terminal Vref is transmitted to the control terminal of the drive transistor through the first initialization module 271 which is turned on. The initialization voltage is less than a high-level signal input into the first power voltage input terminal Vdd, and the initialization voltage may be less than the data voltage corresponding to any gray scale. Therefore, before the data-writing stage, a relatively-low-level voltage is written to the control terminal of the drive module 220, so that the data voltage is more easily written to the control terminal of the drive module 220 during the data-writing stage. Moreover, a low-level signal is input into the second light emission control signal input terminal EM2, and the second light emission control module 250 is turned on, so that the initialization voltage input into the initialization voltage input terminal Vref is transmitted to the first terminal of the light-emitting module 260 through the third initialization module 273 and the second light emission control module 250 which are turned on, and thus the initialization of the light-emitting module 260 is achieved.

In the data-writing stage t130, a low-level signal is input into the first scanning signal input terminal Scan11, the data-writing module 210 and the compensation module 280 are turned on, a data voltage input into the data voltage input terminal Vdata is written to the control terminal of the drive module 220 through the data-writing module 210, the drive module 220 and the compensation module 280 which are turned on, so that the writing of the data voltage is achieved. In the case that the drive module 220 is a drive transistor, the compensation for the threshold voltage of the drive transistor can be achieved in this stage, so that the drive current is not affected by the threshold voltage.

In the light emission stage t140, a low-level signal is input into the first light emission control signal input terminal EM1 and the second light emission control signal input terminal EM2, and the drive module 220 drives the light-emitting module 260 to emit light.

Figure 29:
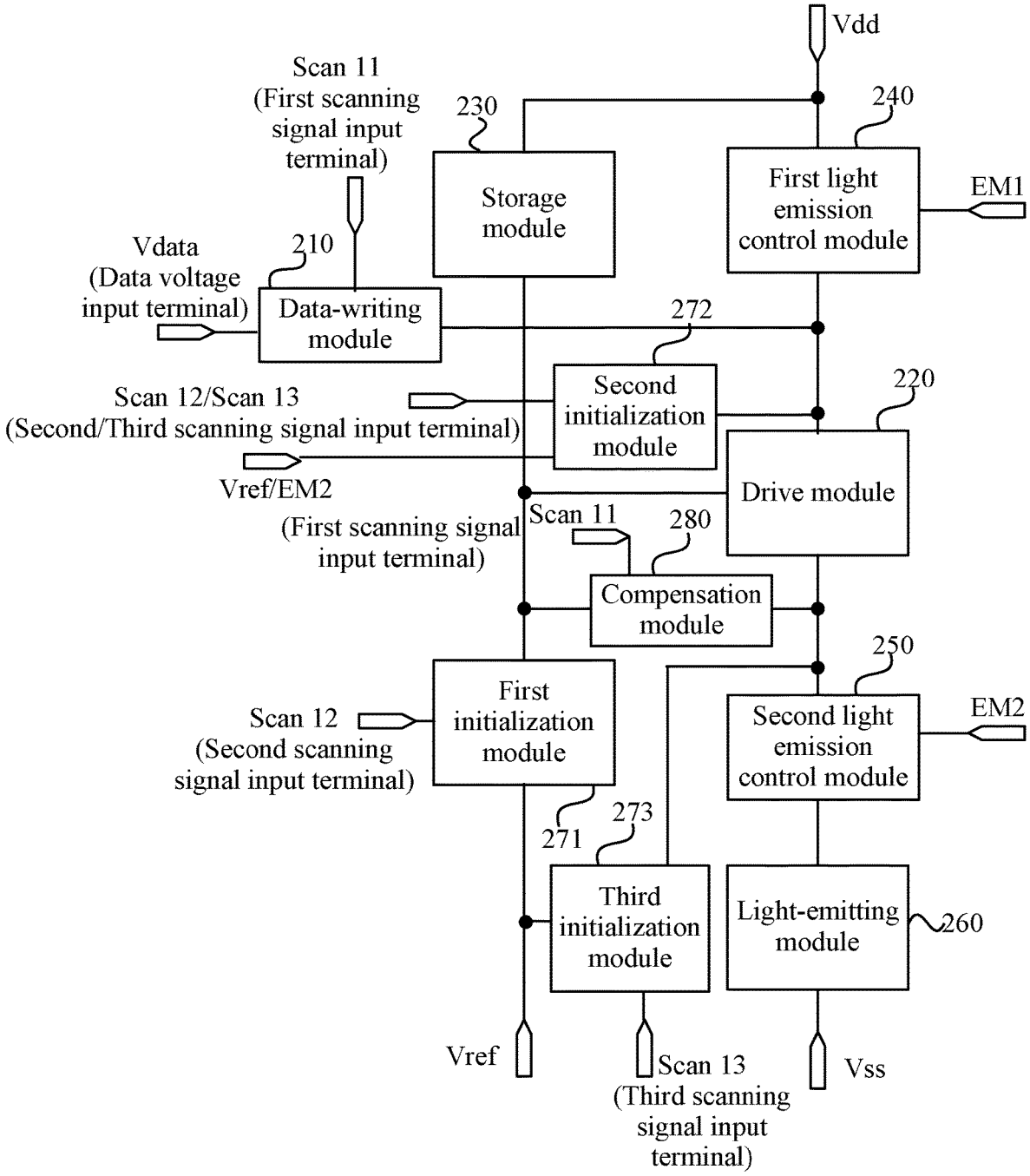
FIG. 29 is a structural diagram of another pixel circuit according to an embodiment of the present disclosure.

FIG. 29 is a structural diagram of another pixel circuit according to an embodiment of the present disclosure. Referring to FIG. 29, in an embodiment, the control terminal of the data-writing module 210 is electrically connected to the first scanning signal input terminal Scan11, the first terminal of the data-writing module 210 is electrically connected to the data voltage input terminal Vdata, and the second terminal of the data-writing module 210 is electrically connected to the first terminal of the drive module 220; and the first terminal of the storage module 230 is electrically connected to the control terminal of the drive module 220, and the second terminal of the storage module 230 is electrically connected to the first power voltage input terminal Vdd.

The pixel circuit further includes a compensation module 280. A control terminal of the compensation module 280 is electrically connected to the first scanning signal input terminal Scan11 of the pixel circuit, a first terminal of the compensation module 280 is electrically connected to the second terminal of the drive module 220, and a second terminal of the compensation module 280 is electrically connected to the control terminal of the drive module 220.

The first terminal of the first initialization module 271 is electrically connected to the initialization voltage input terminal Vref, the control terminal of the first initialization module 271 is electrically connected to a second scanning signal input terminal Scan12, and the second terminal of the first initialization module 271 is electrically connected to the control terminal of the drive module 220.

The pixel circuit further includes a second initialization module 272. The second initialization module 272 includes a control terminal, a first terminal and a second terminal. The first terminal of the second initialization module 272 is electrically connected to the second light emission control signal input terminal EM2 or the initialization voltage input terminal Vref, and the second terminal of the second initialization module 272 is electrically connected to the first terminal of the drive module 220.

The pixel circuit further includes a third initialization module 273 and a third scanning signal input terminal Scan13. A control terminal of the third initialization module 273 is electrically connected to the third scanning signal input terminal Scan13, a first terminal of the third initialization module 273 is electrically connected to the initialization voltage input terminal Vref of the pixel circuit, and a second terminal of the third initialization module 273 is electrically connected to the first terminal of the second light emission control module 250.

The control terminal of the second initialization module 272 is electrically connected to the second scanning signal input terminal Scan12 or the third scanning signal input terminal Scan13.

Figure 30:
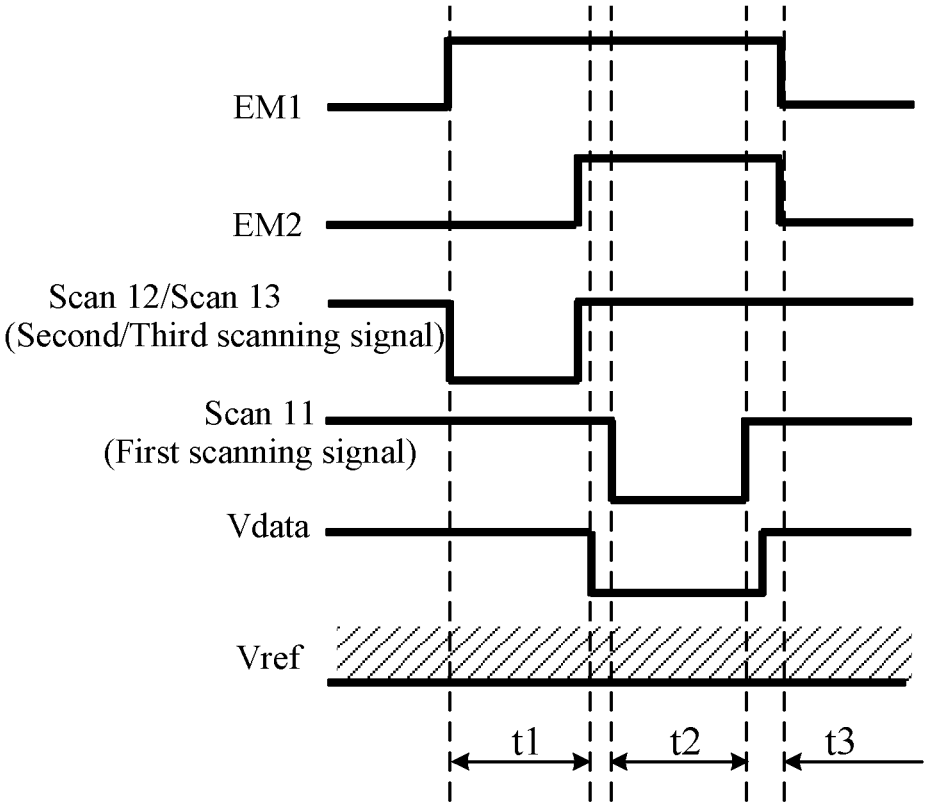
FIG. 30 is another working time sequence diagram applicable to the pixel circuit shown in FIG. 29 according to an embodiment of the present disclosure.

FIG. 30 is a working time sequence diagram of another pixel circuit according to an embodiment of the present disclosure. The working time sequence shown in FIG. 30 can be used to drive the pixel circuit shown in FIG. 29. Referring to FIG. 29 and FIG. 30, the working process of the pixel circuit shown in FIG. 29 may include an initialization stage t1, a data-writing stage t2 and a light emission stage t3.

In the initialization stage t1, a low-level signal is input into the second scanning signal input terminal Scan12, the first initialization module 271 is turned on, and a low-level signal input into the initialization voltage input terminal Vref is transmitted to the control terminal of the drive module 220 through the first initialization module 271 which is turned on. A low-level signal is input into all of the second scanning signal input terminal Scan12, the third scanning signal input terminal Scan13 and the second light emission control signal input terminal EM2, the second initialization module 272 is turned on, the third initialization module 273 is turned on, the second light emission control module 250 is turned on, and the low-level signal input into the initialization voltage input terminal Vref or the low-level signal input into the second light emission control signal input terminal EM2 is transmitted to the first terminal of the drive module 220. That is, in the first initialization stage, the potential of the control terminal and the potential of the first terminal of the drive module 220 are fixed, and the complete reset of the drive module 220 is achieved. Moreover, an initialization voltage (a low-level signal) input into the initialization voltage input terminal Vref is transmitted to the first terminal of the light-emitting module 260 through the third initialization module 273 and the second light emission control module 250 which are turned on, so that the initialization of the light-emitting module 260 is achieved.

In the data-writing stage t2, a low-level signal is input into the first scanning signal input terminal Scan11, the data-writing module 210 and the compensation module 280 are turned on, a data voltage input into the data voltage input terminal Vdata is written to the control terminal of the drive module 220 through the data-writing module 210, the drive module 220 and the compensation module 280 which are turned on, so that the writing of the data voltage is achieved. In the case that the drive module 220 is a drive transistor, the compensation for the threshold voltage of the drive transistor can be achieved in this stage, so that the drive current is not affected by the threshold voltage.

In the light emission stage t3, a low-level signal is input into the first light emission control signal input terminal EM1 and the second light emission control signal input terminal EM2, and the drive module 220 drives the light-emitting module 260 to emit light.

Figure 31:
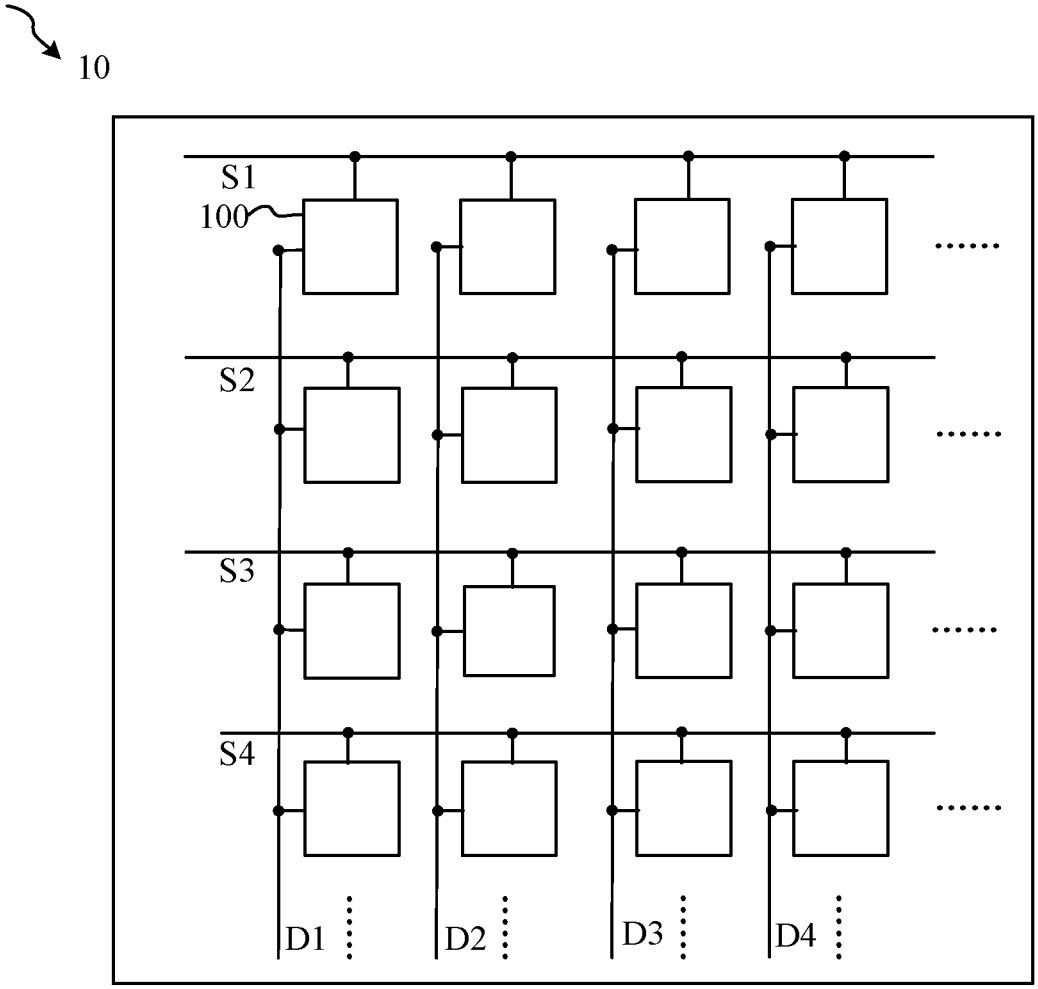
FIG. 31 is a structural diagram of a display panel according to an embodiment of the present disclosure.

The embodiments of the present disclosure further provide a display panel. FIG. 31 is a structural diagram of a display panel according to an embodiment of the present disclosure. Referring to FIG. 31, the display panel 10 includes the pixel circuit 100 provided by any one of the embodiments of the present disclosure. The display panel further includes a plurality of scan lines (S1, S2, S3, S4 . . . ) and a plurality of data lines (D1, D2, D3, D4 . . . ), each scan line can connect a row of pixel circuits, and each data line can connect a column of pixel circuits.

The display panel provided by the embodiments of the present disclosure includes the pixel circuit provided by any one of the embodiments of the present disclosure. The pixel circuit includes a first initialization module, a first terminal of the first initialization module is electrically connected to a second light emission control signal input terminal, a second terminal of the first initialization module is electrically connected to a control terminal of a drive module, and the first initialization module is configured to initialize the control terminal of the drive module under a control of a control signal input into a control terminal of the first initialization module. Further, in a first initialization stage, the potential of the control terminal of the drive module and the potential of the first terminal of the drive module are fixed, drive modules in various pixel circuits in the display panel including the pixel circuit have the same potential at control terminals and have the same potential at first terminals in the first initialization stage, that is, drive modules in a plurality of pixel circuits have the same working state, and that is, drive transistors that drive light-emitting devices to display different gray scales in the previous frame can be restored to the same working state, so that the capture and release of carries on active layers, gate electrode insulating layers and interfaces between the active layers and the gate electrode insulating layers of a plurality of drive transistors are basically the same. Therefore, when different gray scales are converted to the same gray scale, the magnitude of drive currents is the same, the brightness of the light-emitting devices is the same, thus the phenomenon of residual shadow is improved, and the display effects are improved.

What is claimed is:

1. A pixel circuit, comprising: a data-writing module, a drive module, a storage module, a first light emission control module, a second light emission control module, a light-emitting module, a first initialization module, and a second initialization module; wherein the data-writing module is configured to write a data voltage into a control terminal of the drive module in response to a scanning signal input into a first scanning signal input terminal being turned on;

a control terminal of the first light emission control module is electrically connected to a first light emission control signal input terminal of the pixel circuit, a control terminal of the second light emission control module is electrically connected to a second light emission control signal input terminal of the pixel circuit, a first terminal of the drive module is connected to a first power voltage input terminal through the first light emission control module, a second terminal of the drive module is connected to a first terminal of the light-emitting module through the second light emission control module, and a second terminal of the light-emitting module is connected to a second power voltage input terminal; and the storage module is configured to store a potential of the control terminal of the drive module;

the first initialization module comprises a control terminal, a first terminal and a second terminal;

the first terminal of the first initialization module is electrically connected to the second light emission control signal input terminal, and the second terminal of the first initialization module is electrically connected to the control terminal of the drive module; or the pixel circuit comprises an initialization voltage input terminal, the first terminal of the first initialization module is electrically connected to the initialization voltage input terminal, and the second terminal of the first initialization module is electrically connected to the control terminal of the drive module;

the first initialization module is configured to initialize the control terminal of the drive module under a control of a control signal input into the control terminal of the first initialization module;

the second initialization module comprises a control terminal, a first terminal and a second terminal, the first terminal of the second initialization module is electrically connected to the first power voltage input terminal or the second light emission control signal input terminal, and the second terminal of the second initialization module is electrically connected to the first terminal of the drive module; and the second initialization module is configured to initialize the first terminal of the drive module under a control of an input signal of the control terminal of the second initialization module.

2. The pixel circuit of claim 1, wherein the first terminal of the first initialization module is electrically connected to the second light emission control signal input terminal, the second terminal of the first initialization module is electrically connected to the control terminal of the drive module, and the first light emission control signal input terminal and the second light emission control signal input terminal are a same input terminal.

3. The pixel circuit of claim 1, wherein the first terminal of the first initialization module is electrically connected to the second light emission control signal input terminal, and the second terminal of first initialization module is electrically connected to the control terminal of the drive module; and the pixel circuit further comprises a second scanning signal input terminal, and the control terminal of the first initialization module and the control terminal of the second initialization module are electrically connected to the second scanning signal input terminal.

4. The pixel circuit of claim 3, further comprising a third initialization module, wherein a control terminal of the third initialization module is electrically connected to the second scanning signal input terminal, a first terminal of the third initialization module is electrically connected to the initialization voltage input terminal of the pixel circuit, and a second terminal of the third initialization module is electrically connected to the first terminal of the light-emitting module.

5. The pixel circuit of claim 1, further comprising a fourth initialization module, wherein a control terminal of the fourth initialization module is electrically connected to a third scanning signal input terminal of the pixel circuit, a first terminal of the fourth initialization module is electrically connected to the initialization voltage input terminal of the pixel circuit, and a second terminal of the fourth initialization module is electrically connected to the control terminal of the drive module.

6. A pixel circuit, comprising: a data-writing module, a drive module, a storage module, a first light emission control module, a second light emission control module, a light-emitting module, a first initialization module, and a second initialization module; wherein the data-writing module is configured to write a data voltage into a control terminal of the drive module in response to a scanning signal input into a first scanning signal input terminal being turned on;

a control terminal of the first light emission control module is electrically connected to a first light emission control signal input terminal of the pixel circuit, a control terminal of the second light emission control module is electrically connected to a second light emission control signal input terminal of the pixel circuit, a first terminal of the drive module is connected to a first power voltage input terminal through the first light emission control module, a second terminal of the drive module is connected to a first terminal of the light-emitting module through the second light emission control module, and a second terminal of the light-emitting module is connected to a second power voltage input terminal; and the storage module is configured to store a potential of the control terminal of the drive module;

the first initialization module comprises a control terminal, a first terminal and a second terminal;

the first terminal of the first initialization module is electrically connected to the second light emission control signal input terminal, and the second terminal of the first initialization module is electrically connected to the control terminal of the drive module; or the pixel circuit comprises an initialization voltage input terminal, the first terminal of the first initialization module is electrically connected to the initialization voltage input terminal, and the second terminal of the first initialization module is electrically connected to the control terminal of the drive module;

the first initialization module is configured to initialize the control terminal of the drive module under a control of a control signal input into the control terminal of the first initialization module;

the second initialization module comprises a control terminal, a first terminal and a second terminal; the first terminal of the second initialization module is electrically connected to the initialization voltage input terminal, and the second terminal of the second initialization module is electrically connected to the first terminal of the drive module; and the second initialization module is configured to initialize the first terminal of the drive module under a control of an input signal of the control terminal of the second initialization module.

7. A pixel circuit, comprising: a data-writing module, a drive module, a storage module, a first light emission control module, a second light emission control module, a light-emitting module, a first initialization module, and a second initialization module; wherein the data-writing module is configured to write a data voltage into a control terminal of the drive module in response to a scanning signal input into a first scanning signal input terminal being turned on;

a control terminal of the first light emission control module is electrically connected to a first light emission control signal input terminal of the pixel circuit, a control terminal of the second light emission control module is electrically connected to a second light emission control signal input terminal of the pixel circuit, a first terminal of the drive module is connected to a first power voltage input terminal through the first light emission control module, a second terminal of the drive module is connected to a first terminal of the light-emitting module through the second light emission control module, and a second terminal of the light-emitting module is connected to a second power voltage input terminal; and the storage module is configured to store a potential of the control terminal of the drive module;

the first initialization module comprises a control terminal, a first terminal and a second terminal;

the first terminal of the first initialization module is electrically connected to the second light emission control signal input terminal, and the second terminal of the first initialization module is electrically connected to the control terminal of the drive module; or the pixel circuit comprises an initialization voltage input terminal, the first terminal of the first initialization module is electrically connected to the initialization voltage input terminal, and the second terminal of the first initialization module is electrically connected to the control terminal of the drive module;

the first initialization module is configured to initialize the control terminal of the drive module under a control of a control signal input into the control terminal of the first initialization module;

the control terminal of the first initialization module is electrically connected to a second scanning signal input terminal;

the second initialization module comprises a control terminal, a first terminal and a second terminal; the first terminal of the second initialization module is electrically connected to the second light emission control signal input terminal or the initialization voltage input terminal, and the second terminal of the second initialization module is electrically connected to the first terminal of the drive module;

the pixel circuit further comprises a third initialization module and a third scanning signal input terminal, a control terminal of the third initialization module is electrically connected to the third scanning signal input terminal, a first terminal of the third initialization module is electrically connected to the initialization voltage input terminal of the pixel circuit, and a second terminal of the third initialization module is electrically connected to a first terminal of the second light emission control module; and the control terminal of the second initialization module is electrically connected to the second scanning signal input terminal or the third scanning signal input terminal.

8. The pixel circuit of claim 1, wherein a control terminal of the data-writing module is electrically connected to the first scanning signal input terminal, a first terminal of the data-writing module is electrically connected to a data voltage input terminal, and a second terminal of the data-writing module is electrically connected to the first terminal of the drive module; and a first terminal of the storage module is electrically connected to the control terminal of the drive module, and a second terminal of the storage module is electrically connected to the first power voltage input terminal; and the pixel circuit further comprises a compensation module, a control terminal of the compensation module is electrically connected to the first scanning signal input terminal of the pixel circuit, a first terminal of the compensation module is electrically connected to the second terminal of the drive module, and a second terminal of the compensation module is electrically connected to the control terminal of the drive module.

9. The pixel circuit of claim 6, wherein a control terminal of the data-writing module is electrically connected to the first scanning signal input terminal, a first terminal of the data-writing module is electrically connected to a data voltage input terminal, and a second terminal of the data-writing module is electrically connected to the first terminal of the drive module; and a first terminal of the storage module is electrically connected to the control terminal of the drive module, and a second terminal of the storage module is electrically connected to the first power voltage input terminal; and the pixel circuit further comprises a compensation module, a control terminal of the compensation module is electrically connected to the first scanning signal input terminal of the pixel circuit, a first terminal of the compensation module is electrically connected to the second terminal of the drive module, and a second terminal of the compensation module is electrically connected to the control terminal of the drive module.

10. The pixel circuit of claim 7, wherein a control terminal of the data-writing module is electrically connected to the first scanning signal input terminal, a first terminal of the data-writing module is electrically connected to a data voltage input terminal, and a second terminal of the data-writing module is electrically connected to the first terminal of the drive module; and a first terminal of the storage module is electrically connected to the control terminal of the drive module, and a second terminal of the storage module is electrically connected to the first power voltage input terminal; and the pixel circuit further comprises a compensation module, a control terminal of the compensation module is electrically connected to the first scanning signal input terminal of the pixel circuit, a first terminal of the compensation module is electrically connected to the second terminal of the drive module, and a second terminal of the compensation module is electrically connected to the control terminal of the drive module.

11. The pixel circuit of claim 1, wherein a working process of the pixel circuit comprises a first initialization stage, a data-writing stage and a light emission stage; and in the first initialization stage, a signal input into the second light emission control signal input terminal is same as a signal input into the first power voltage input terminal in a case that the first terminal of the first initialization module is electrically connected to the second light emission control signal input terminal.

12. The pixel circuit of claim 1, wherein a working process of the pixel circuit comprises a first initialization stage, a data-writing stage and a light emission stage; and in the first initialization stage, a signal input into the initialization voltage input terminal is same as a signal input into the first power voltage input terminal in a case that the first terminal of the first initialization module is electrically connected to the initialization voltage input terminal.

13. The pixel circuit of claim 1, wherein the control terminal of the second initialization module is electrically connected to a second scanning signal input terminal.

14. The pixel circuit of claim 7, wherein the second initialization module is configured to initialize the first terminal of the drive module under a control of an input signal of the control terminal of the second initialization module.

15. The pixel circuit of claim 1, wherein the first terminal of the first initialization module is electrically connected to the initialization voltage input terminal; the pixel circuit further comprises a third initialization module and a third scanning signal input terminal, a control terminal of the third initialization module is electrically connected to the third scanning signal input terminal, a first terminal of the third initialization module is electrically connected to the initialization voltage input terminal of the pixel circuit, and a second terminal of the third initialization module is electrically connected to a first terminal of the second light emission control module.

16. A display panel comprising the pixel circuit of claim 1.

17. A display panel comprising the pixel circuit of claim 6.

18. A display panel comprising the pixel circuit of claim 7.

* * * * *